US006601724B1

(12) United States Patent
Koefelda et al.

(10) Patent No.: US 6,601,724 B1
(45) Date of Patent: Aug. 5, 2003

(54) COLLAPSIBLE MERCHANDIZING CONTAINER

(75) Inventors: Gerald R. Koefelda, Hermosa Beach, CA (US); Roger S. Hsu, Torrance, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 09/444,148

(22) Filed: Nov. 20, 1999

(51) Int. Cl.[7] ..... B65D 6/16
(52) U.S. Cl. ..... 220/6; 220/4.28; 220/4.34
(58) Field of Search ..... 220/6, 4.28, 4.34, 220/608, 1.5

(56) References Cited

U.S. PATENT DOCUMENTS

| | | | | | |
|---|---|---|---|---|---|
| 3,130,850 | A | * | 4/1964 | Oakey et al. | 220/6 |
| 3,398,850 | A | * | 8/1968 | Kennard | 220/6 |
| 3,446,415 | A | | 5/1969 | Bromley | |
| 3,628,683 | A | | 12/1971 | Friedrich et al. | |
| 3,770,186 | A | * | 11/1973 | Kupersmit | 206/600 |
| 3,874,546 | A | | 4/1975 | Sanders et al. | |
| B 513,789 | | | 2/1976 | Koen | |
| 3,973,692 | A | | 8/1976 | Cloyd | |
| 4,005,795 | A | | 2/1977 | Mikkelsen et al. | |
| 4,030,600 | A | * | 6/1977 | Heaps | 206/597 |
| 4,044,910 | A | | 8/1977 | Box | |
| 4,062,467 | A | | 12/1977 | Friedrich | |
| 4,081,099 | A | | 3/1978 | Shead | |
| 4,170,313 | A | | 10/1979 | Caves et al. | |
| 4,181,236 | A | | 1/1980 | Prodel | |
| 4,300,695 | A | | 11/1981 | Hsu | |
| 4,349,120 | A | | 9/1982 | DiNardo | |
| 4,663,803 | A | | 5/1987 | Gora | |
| 4,674,647 | A | | 6/1987 | Gyenge et al. | |
| 4,726,486 | A | * | 2/1988 | Masuda | 220/6 |
| 4,735,331 | A | | 4/1988 | Keenan et al. | |
| 4,741,032 | A | | 4/1988 | Hampton | |
| 4,765,480 | A | | 8/1988 | Malmanger | |
| 4,775,068 | A | | 10/1988 | Reiland et al. | |
| 4,776,457 | A | | 10/1988 | Ferraroni | |
| 4,781,300 | A | | 11/1988 | Long | |
| 4,809,874 | A | | 3/1989 | Pehr | |
| 4,846,089 | A | | 7/1989 | Cedergreen | |
| 4,887,747 | A | | 12/1989 | Ostrowsky et al. | |
| D306,264 | S | | 2/1990 | Malmanger | |
| 4,917,255 | A | * | 4/1990 | Foy et al. | 220/4.28 |
| 4,923,079 | A | | 5/1990 | Foy | |
| 4,940,155 | A | | 7/1990 | Hewson | |
| 4,960,223 | A | | 10/1990 | Chiang et al. | |
| 4,967,927 | A | | 11/1990 | Reiland et al. | |
| 4,979,634 | A | | 12/1990 | Begley | |
| 5,038,953 | A | | 8/1991 | Radar | |
| 5,048,715 | A | | 9/1991 | Wolff | |
| 5,114,037 | A | | 5/1992 | Hillis et al. | |
| 5,161,709 | A | | 11/1992 | Oestreich, Jr. | |

(List continued on next page.)

FOREIGN PATENT DOCUMENTS

| | | | | |
|---|---|---|---|---|
| DE | 27 34 964 A1 | | 2/1979 | |
| EP | 0 127 414 | | 12/1984 | |
| EP | 0 178211 A1 | | 9/1985 | |
| EP | 0 404041 A1 | | 6/1990 | |
| SU | 662432 | * | 5/1979 | 220/6 |
| WO | WO 86/01182 | | 2/1986 | |
| WO | WO 97/15502 | | 5/1997 | |

*Primary Examiner*—Mickey Yu
*Assistant Examiner*—Troy Arnold
(74) *Attorney, Agent, or Firm*—Brooks & Kushman P.C.

(57) ABSTRACT

A collapsible display container includes a base and a pair of opposed side walls each pivotably attached to the base. The side walls are orientable between an assembled position and a second position. At least one of the side walls includes a display member which is mounted to it. The display member is movable between an open position and a closed position. Thus, when the display member is in the open position and the at least one side wall is in the assembled position, the interior of the container is accessible through the at least one side wall.

23 Claims, 20 Drawing Sheets

U.S. PATENT DOCUMENTS 5,183,180 A 2/1993 Hawkins et al.
5,289,935 A 3/1994 Hillis et al.
5,328,048 A 7/1994 Stein
5,353,948 A 10/1994 Lanoue et al.
5,398,834 A 3/1995 Umiker
5,474,197 A 12/1995 Hillis et al.
5,474,200 A 12/1995 Nicholson
5,515,987 A 5/1996 Jacques et al.
5,558,241 A * 9/1996 Huffstutler, Jr. et al. ..... 220/6
5,588,549 A * 12/1996 Furtner ..... 220/6
5,622,276 A 4/1997 Simmons
5,632,392 A 5/1997 Oh
5,699,926 A 12/1997 Jacques et al.
5,788,103 A * 8/1998 Wagner et al. ..... 220/6
5,829,617 A 11/1998 Umiker
5,850,936 A 12/1998 Umiker
5,853,099 A 12/1998 Lessard
6,015,056 A 1/2000 Overholt et al.

* cited by examiner

COLLAPSIBLE MERCHANDIZING CONTAINER

TECHNICAL FIELD

This invention relates to a multi-purpose collapsible merchandising container adaptable for the storage, transport, and display of produce items and other goods.

BACKGROUND ART

Collapsible containers and crates are commonly used to transport and store a variety of items. Such crates are typically formed of injection molded plastic and are frequently adapted to receive perishable food items, such as produce. When assembled, such containers are rectangular in shape and have a flat base surrounded by four upstanding side panels which are joined to the flat base. When the containers are not in use, the collapsible feature of the containers allows the containers to be folded or otherwise reduced in size, thereby providing a desired compact size when storage space is minimal.

Current collapsible containers, however, are not well suited for displaying its contents, particularly at the point of sale. The task of investigating the contents of a particular collapsible container is even more arduous in a situation where the containers are stacked upon each other. Under these circumstances, the containers must typically be unstacked in order to discover and access its contents.

Consequently, there is a need for an improved collapsible container which is suitable for display purposes. The improved container should allow for enhanced visibility of the contents of the container, as well as access to the contents of the container. The improved container should also be capable of stacking with similar containers when assembled and nested with similar containers when folded. The container should also allow for visibility and access under conditions where the containers are stacked. The container should also have a sturdy construction and load-bearing properties.

DISCLOSURE OF INVENTION

It is an object of the present invention to provide a collapsible merchandising display container which provides for access to the contents of the container, particularly when the container is in a stacked orientation with a similar container or when conventional access to the container through its upper opening is difficult or inconvenient.

It is another object according to the present invention to provide a collapsible display container which provides access and visibility to the contents of the container from the side, even when the side walls of the container are in an assembled and up orientation.

It is still another object according to the present invention to provide a collapsible display container which incorporates an access panel to the contents of the container which is movable between an open and closed state with relative ease.

It is yet another object according to the present invention to provide a collapsible display container which is stackable with like containers when assembled, and nestable with like containers when collapsed.

Moreover, it is an object according to the present invention to provide a collapsible display container which is cost effective to manufacture and efficient to assemble.

Further, it is another object according to the present invention to provide a collapsible display container which is capable of nesting with the like containers when in a collapsed position, and is also capable of stacking with like containers when in the assembled position.

It is still another object according to the present invention to provide a container that has a bottom which is robust and has a design which is sufficiently able to support the load placed therein.

In carrying out the above objects, features and advantages according to the present invention, provided is a collapsible display container including a base and a pair of opposed side walls each pivotably attached to the base. The side walls are orientable between an assembled position and a second position (collapsed or down position). At least one of the side walls includes a display member which is mounted to the wall. The display member is movable between an open position and a closed position. Thus, when the display member is in the open position and the at least one side wall is in the assembled position, the interior of the container is accessible through the at least one side wall.

The display member is preferably pivotably attached to the at least one side wall. The display member may also be releasably mounted to the at least one side wall. In a preferred embodiment, when the display member is in the closed position and the side wall is in the assembled position, the display member is generally co-planar with the side wall. In one embodiment, when the display member is in the closed position and the side wall is in the assembled position, one of the display member and the side wall includes a latch member and the other includes a recess for receiving the latch member. The display panel member is movable between the range of approximately 0° to 180°, and in one embodiment the open display panel member is parallel to the plane of its corresponding side wall.

The display member has a display member upper edge and the side wall has a side wall upper edge, wherein when the display member is in the closed position and the at least one side wall is in the assembled position, the display member upper edge is substantially co-linear with the side wall upper edge. Also, when the display member is in the open position and the at least one side wall is in the assembled position, the display member upper edge does not project below the plane of the base.

The collapsible container disclosed herein preferably also includes a second pair of opposed side walls each pivotably attached to the base and orientable between an assembled position and an unassembled position. Each of the second pair of opposed side walls is releasably mounted to an adjacent one of the pair of opposed side walls. One of the pair of opposed side walls and second pair of opposed side walls each includes a pair of opposed lateral flanges inwardly depending therefrom and integral therewith, each lateral flange having a latch receiver formed therein, the latch receiver including an aperture and a flexible latch hinge and having a latch release member actuable by a user. The other of the pair of opposed side walls and second pair of opposed side walls each includes a pair of opposed lateral edges, each lateral edge having a latching member attached thereto. Thus, when the container is oriented in an assembled position, each lateral flange abuts an adjacent lateral edge so that each aperture receives a corresponding latching member which is fastened into position by the latch hinge, forming a secure attachment between the first and second pairs of opposed side walls. Also, in order to return the container to a collapsed position from the assembled position, each latch release member is actuated by the user in order to release the latching member fastened therein.

The base of the container includes a first and second pair of opposed edges. The pair of opposed side walls and the second pair of opposed side walls are pivotably attached to a corresponding one of the first and second pair of opposed edges. In one embodiment, one of the first and second pairs of opposed edges are each defined by an upstanding base wall. When the pairs of side walls are oriented in the second position, they are oriented in one of an inwardly folded orientation or an outwardly folded orientation.

The container preferably has a pair of opposed display panel members attached to opposed side walls, and may also have a third or fourth display panel member on the remaining side walls.

The above objects and other objects, features, and advantages of the present invention are readily apparent from the following detailed description of the best mode for carrying out the invention when taken in connection with the accompanying drawings.

BRIEF DESCRIPTION OF DRAWINGS

FIG. 7 is a bottom plan view of the container of FIG. 1;

FIGS. 20*a*, 20*b*, and 20*c*, illustrate a plan view of two like containers according to the present invention in the inwardly folded and nested orientation as shown in FIG. 19, for illustrative purposes showing the bottom surface of one container in solid lines and the end walls of the subjacent container in phantom lines, such that the bottom surface design mates with and accommodates the corresponding outer surface of the inwardly folded end walls, to provide for a stable and secure nested configuration, wherein FIGS. 20*a–c* illustrates that the bottom design may accommodate various end wall heights, including a first, relatively short end wall height (FIG. 20*a*), a second, intermediate end wall height (FIG. 20*b*), and a third, relatively long end wall height (FIG. 20*c*);

BEST MODE FOR CARRYING OUT THE INVENTION

Figure 1:
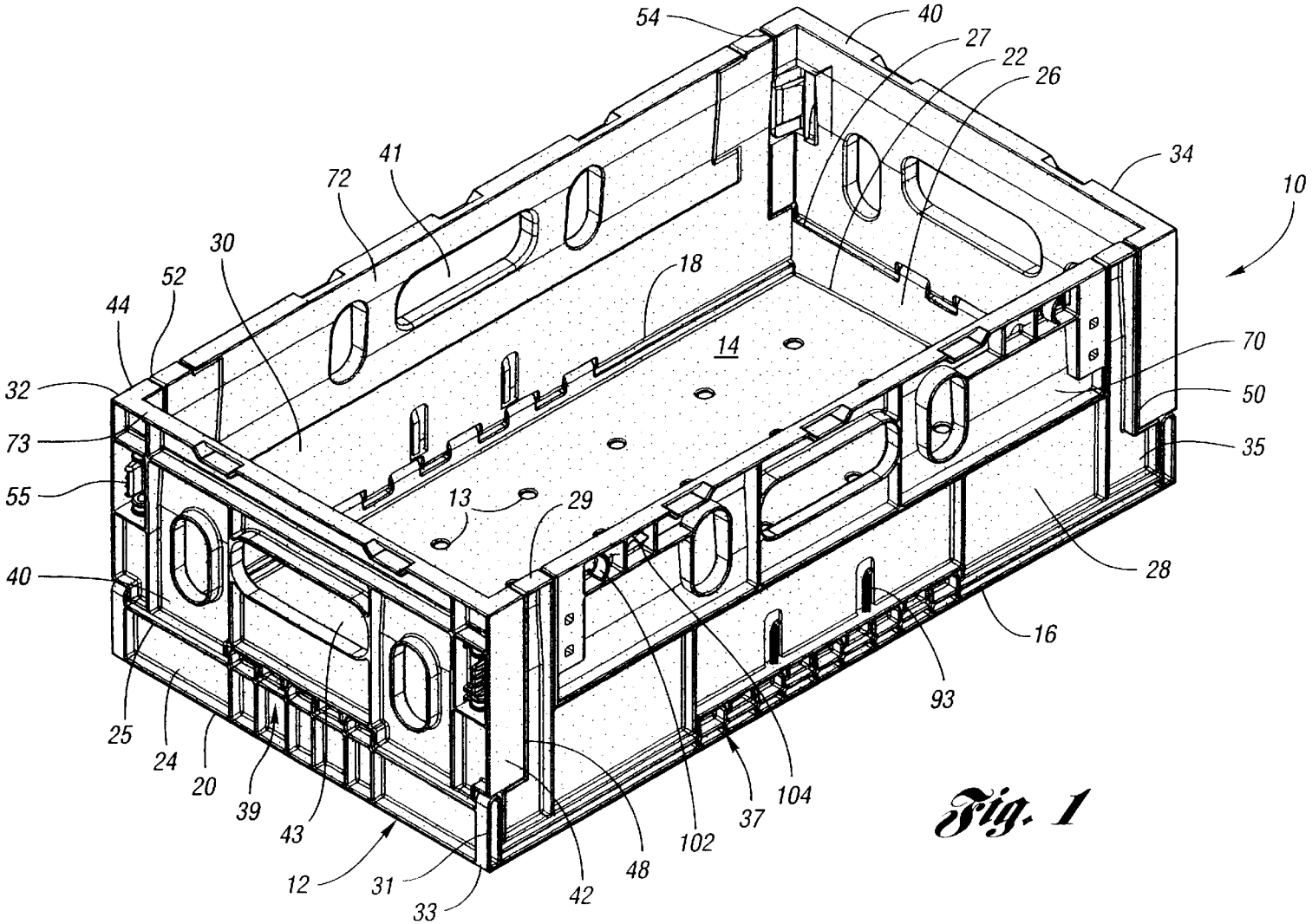
FIG. 1 of the drawings illustrates a perspective view of the collapsible container according to the present invention oriented in an assembled state.

With reference to FIG. 1 of the drawings, illustrated therein is collapsible display container 10 according to the present invention. The components of container 10 are typically formed of various types of plastic or polymeric material via an injection molding or other plastic molding process suitable to this application. Container 10 may be used for the storage, transport, and display of goods, and may also be referred to as a collapsible crate. While container 10 is suitable for many uses, container 10 is particularly suitable for the storage, transport, and display of produce such as fruits and vegetables, where circulation of air and/or refrigerated gas is necessary to keep the produce fresh and consumable while it reaches the market. This circulation is fostered through the plurality of apertures 13 provided in base 12 of container 10, as shown as annular holes in FIGS. 1, 4, and 7, and as slots in FIGS. 18–21.

Container 10 includes a base member 12 having a bottom panel 14 which serves as the lower support for the container. As is best shown in the top plan view of FIG. 4 and bottom plan view of FIG. 7, bottom panel 14 is generally rectangular in shape and has four edges—namely, a pair of opposed side edges 16 and 18, and a pair of opposed end edges 20 and 22. Base 12 further includes integrally molded upstanding flanges 24 and 26 (or base walls) oriented perpendicular to bottom panel 14, each defining an upper side edge 25 and 27, respectively. As is well understood in the art, the wall thickness of each of the walls and components illustrated and disclosed herein may vary depending on the intended usage and other characteristics desired from container 10.

Figure 5:
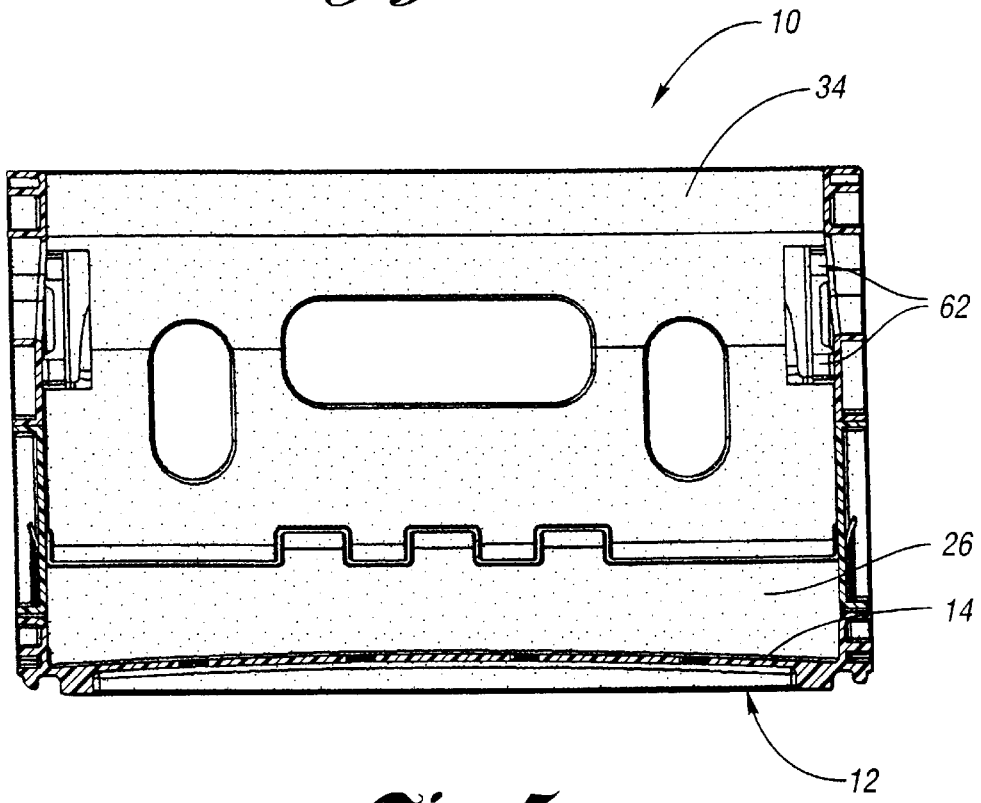
FIG. 5 is a sectional view of the container taken along the line 5—5 of FIG. 4.
Figure 4:
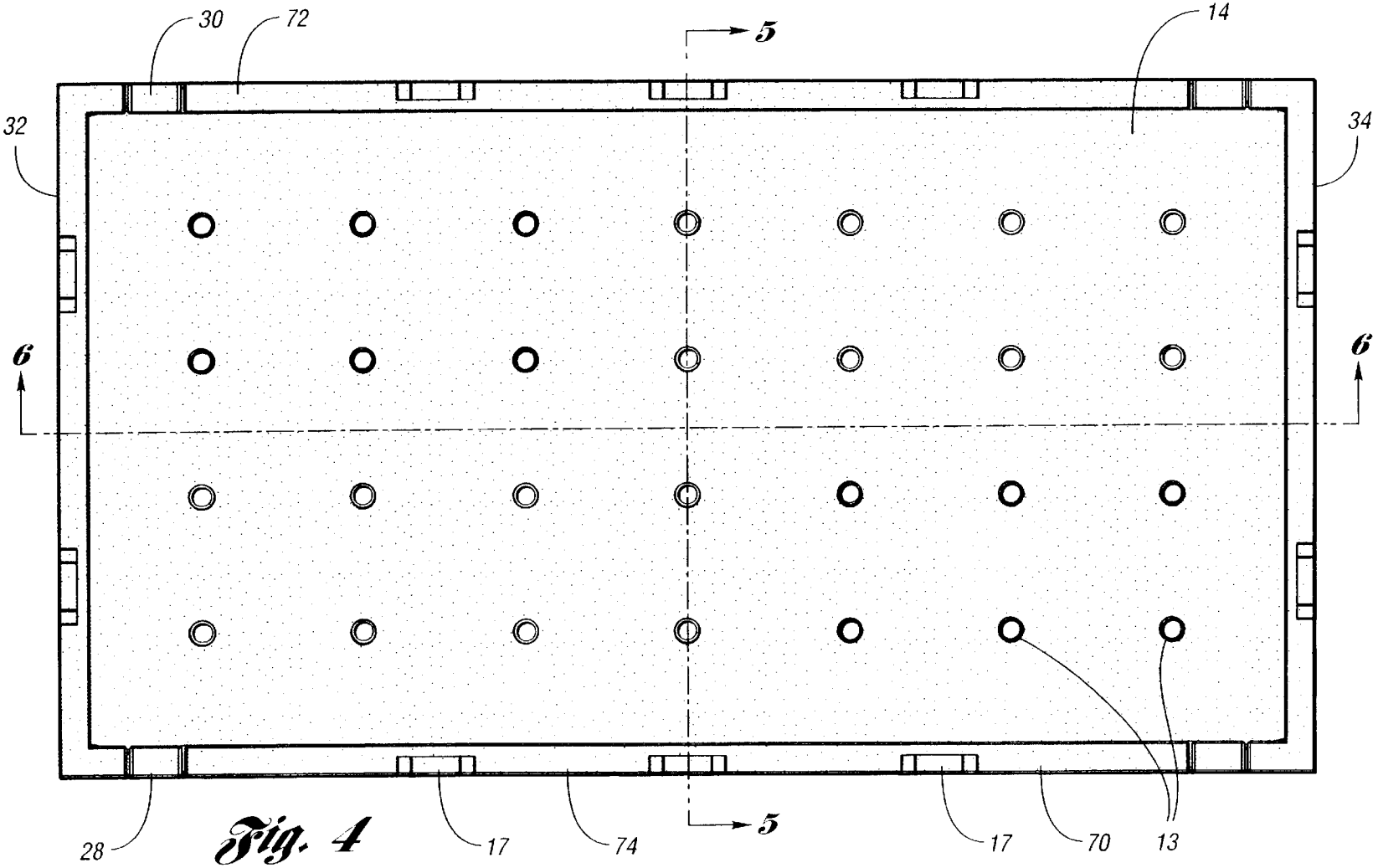
FIG. 4 illustrates a top plan view of the container of FIG. 1.
Figure 2:
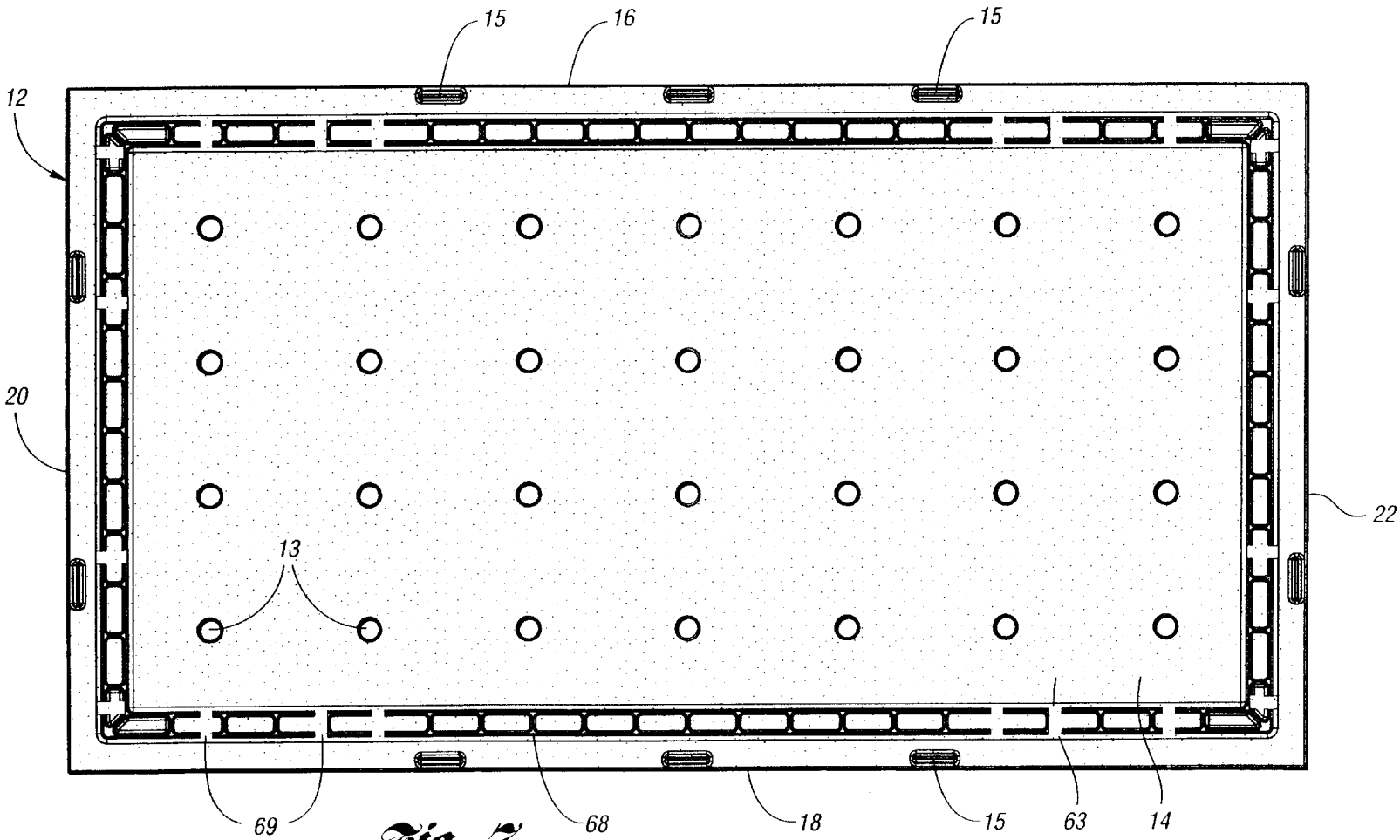

With reference to FIG. 5, illustrated herein is a sectional view of container 10 taken along the transverse centerline 5—5 of FIG. 4. As shown therein, bottom panel 14 is curved between edges 16 and 18 such that it is bowed upward with a relatively slight arcuate shape, instead of having a typical flat profile. This bowed feature of bottom panel 14 serves to add stability to the container and augment the life of the container, as well as provide protection to the contents of containers stacked therebelow. Particularly, when container 10 is filled or has goods placed therein, the weight of the goods will exert load upon bottom panel 14. Under this load, the bowed design of bottom panel 14 will tend to cause bottom 14 to flatten. This is desirable in comparison to a container having a typically flat bottom which under the same load described above, will tend to sag and bow downward, thereby, decreasing the container's strength, stability, and life, and also possibly causing damage to the contents of the container therebelow.

Figure 2:
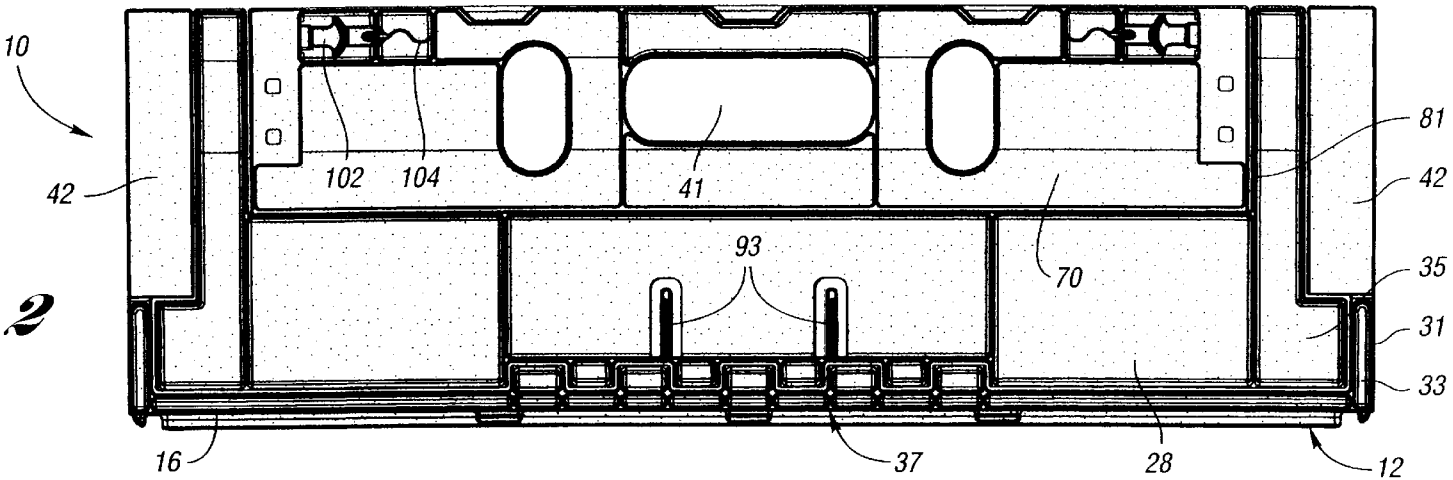
FIG. 2 illustrates a side elevational view of the container of FIG. 1.
Figure 8:
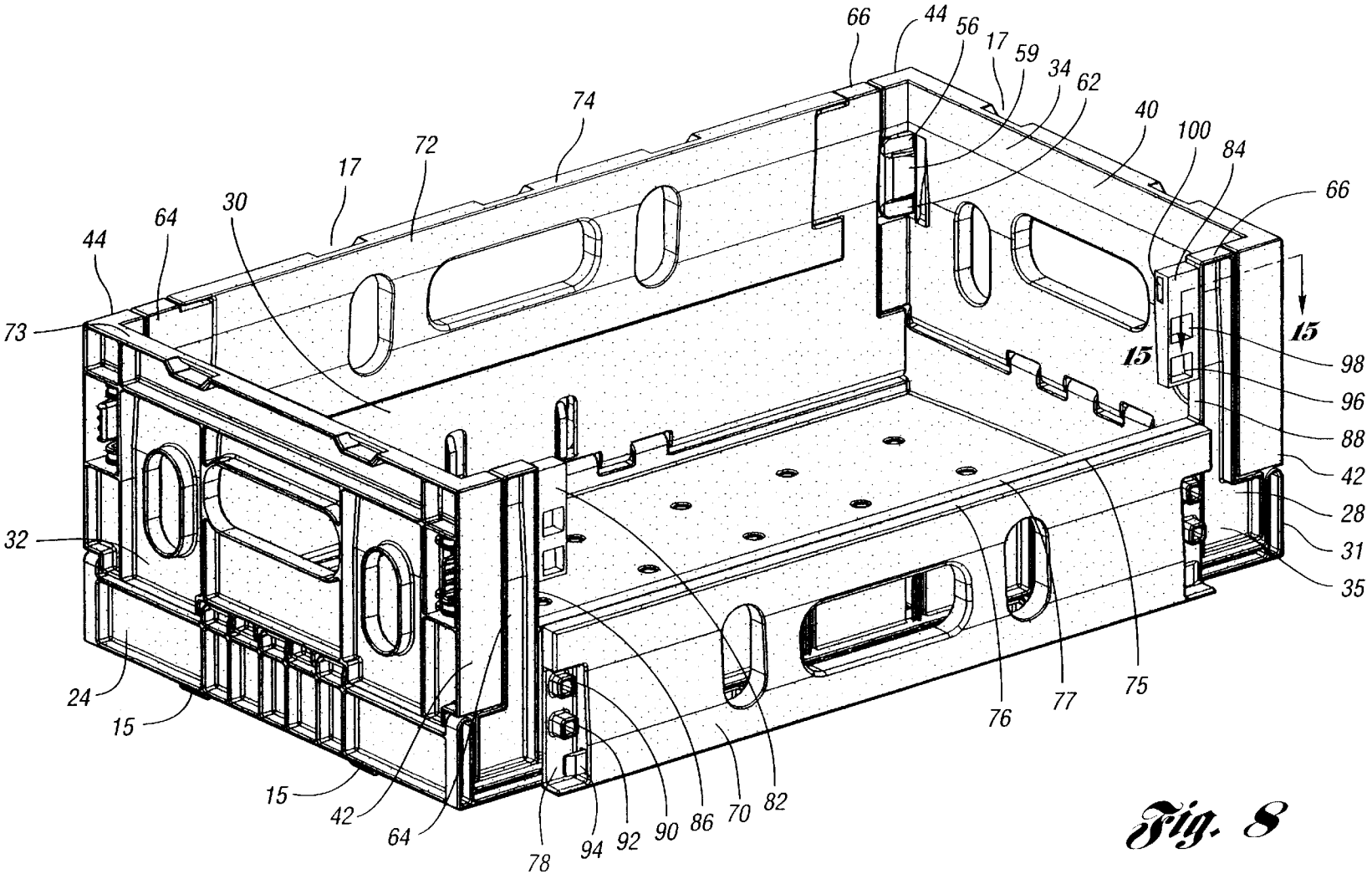
FIG. 8 of the drawings is a perspective view of the collapsible container of FIG. 1 with the merchandising panel in a down position.
Figure 11:
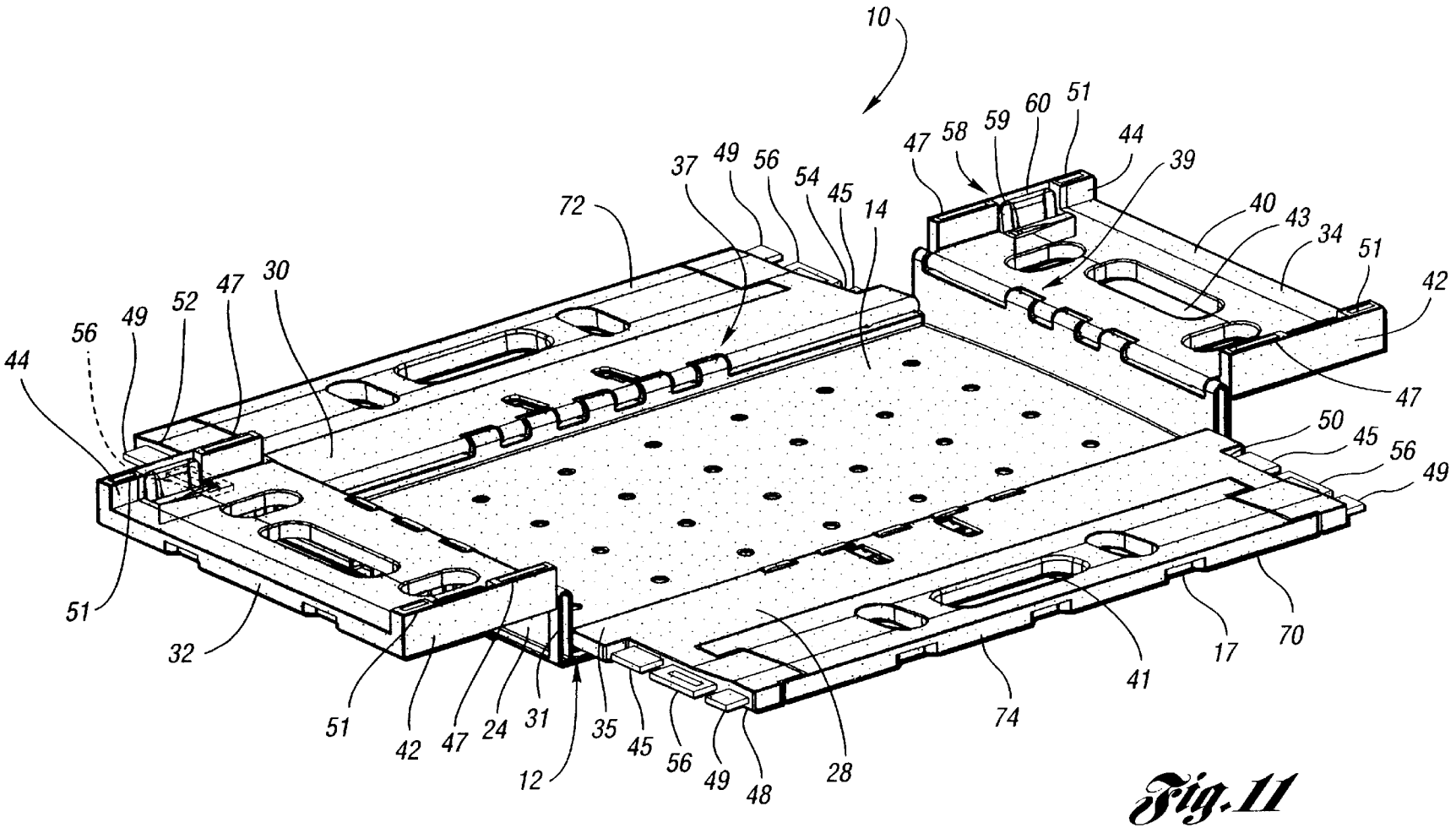
FIG. 11 illustrates the container of FIG. 1 with the side walls in an outwardly folded orientation.
Figure 12:
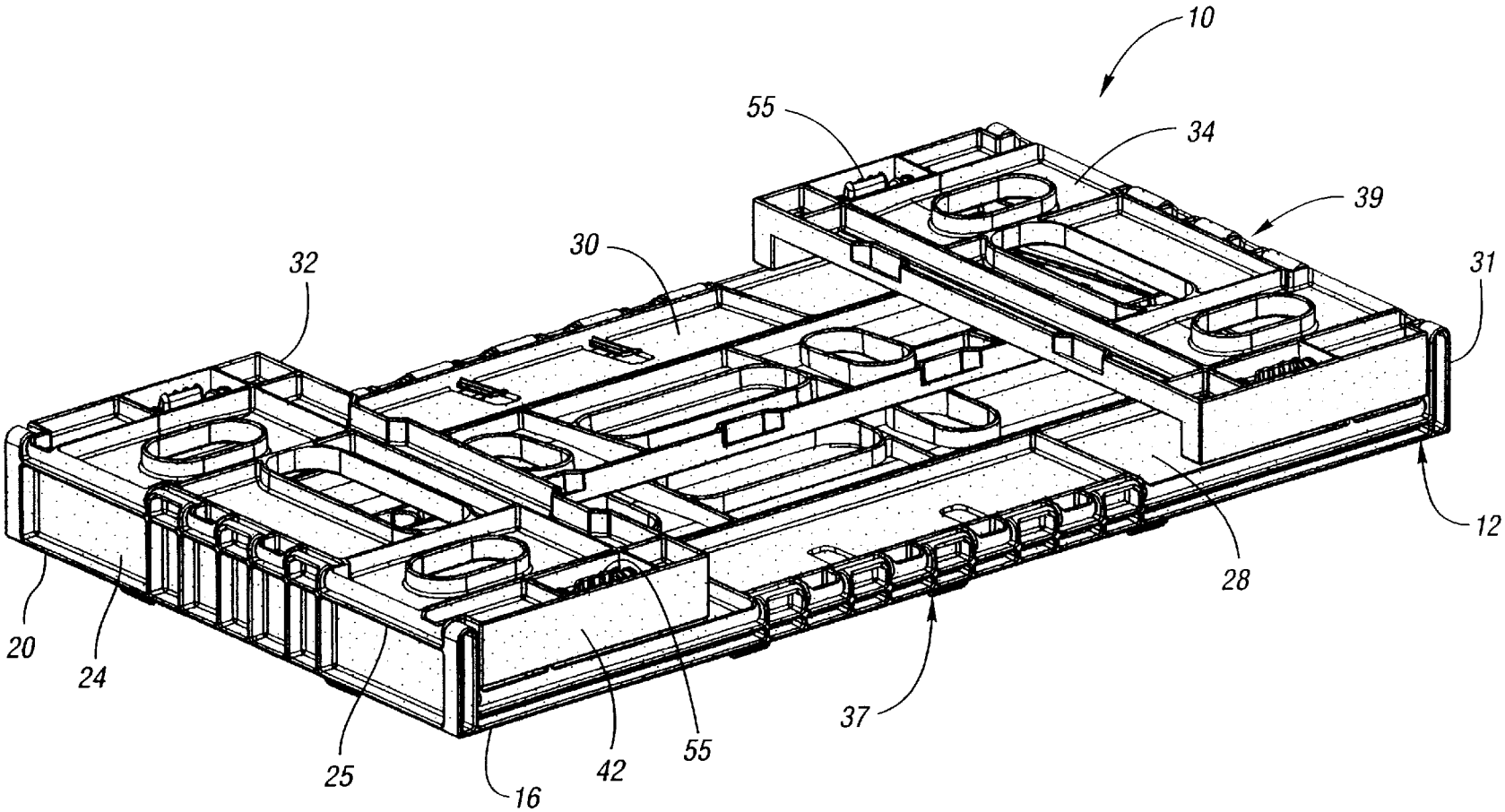
FIG. 12 illustrates the container of FIG. 1 with the side walls in an inwardly folded orientation, wherein the opposed side walls are first folded inwardly and then the opposed end walls are folded inwardly.

As shown in FIGS. 1–2, and 11, container 10 also includes a first pair of opposed side walls 28 and 30, which are situated opposite each other across bottom panel 14. Side walls 28 and 30 are each pivotably attached to base 12 by way of a hinging configuration or system 37 (best shown in FIG. 13), located at edges (16,18) of bottom panel 15. Thus, side walls (28, 30) fold or pivot relative to base 12 at edges 16 and 18. Such hinging system 37 allows side walls 28 and 30 to be foldably positioned in three orientations: the assembled container orientation, as illustrated in FIGS. 1 and 8; the outwardly collapsible orientation, as illustrated in FIG. 11; and the inwardly collapsible orientation, as illustrated in FIG. 12. As shown in FIGS. 1 and 2, hinging system 37 does not extend the length of base 14 but terminates at a distance away from each upstanding flange 24 and 26, as well as a distance remote from an adjacent corresponding corner line 31.

As illustrated in FIGS. 1–3, and 11, container 10 further includes a second pair of opposed side walls 32 and 34. For ease of reference and discussion, second pair of opposed side walls is herein referred to as a pair of opposed end walls 32 and 34. Like side walls 28 and 30, end walls 32 and 34 are similarly pivotably attached to base 12 by way of a hinging mechanism 39 which is similar in structure to hinging mechanism 37 described above, and as shown in FIG. 13. However, unlike the side walls, end walls 32, 34 are folded relative to base 12 at a distance remote from bottom panel 14. Particularly, end walls 32 and 34 are pivotably attached to upstanding flanges 24 and 26, respectively, of base 12, proximate upper edges 25, 27, respectively, at a distance remote from bottom panel 14. The height of upstanding base wall flanges 24, 26 defines the aforementioned distance from which end walls 32 and 34 are remote from bottom panel 14. As with the other walls discussed herein, end walls 32 and 34 are orientable in three positions: assembled shown as in FIGS. 1 and 8; outwardly collapsed as in FIG. 11; and inwardly collapsed as in FIG. 12.

As best shown in FIGS. 1, 11 and 12, each end wall 32 and 34 has a U-shaped cross section formed by a main end wall portion 40, and two shorter flange portions 42 and 44 integrally attached to main end wall portion 40 and located on either side of main end wall portion 40. Flange portions 42 and 44 are each oriented perpendicular to main end wall portion 40 and, in the assembled orientation of FIG. 1, are directed inward toward the other end wall (32 or 34) and side walls 28 and 30. In an assembled orientation, the outer surface of flange portions are co-planar with side walls 28,30.

In accordance with the teachings of the present invention, further included in container 10 is a locking or latching system for latching side walls (28,30) together with end walls (32,34) to achieve the desired stability when container 10 is oriented in the assembled orientation, as in FIG. 1. With reference to FIG. 11, provided on each lateral edge (48, 50) and (52, 54) of side walls 28 and 30, respectively, is a latch member 56 extending outwardly therefrom.

Figure 9:
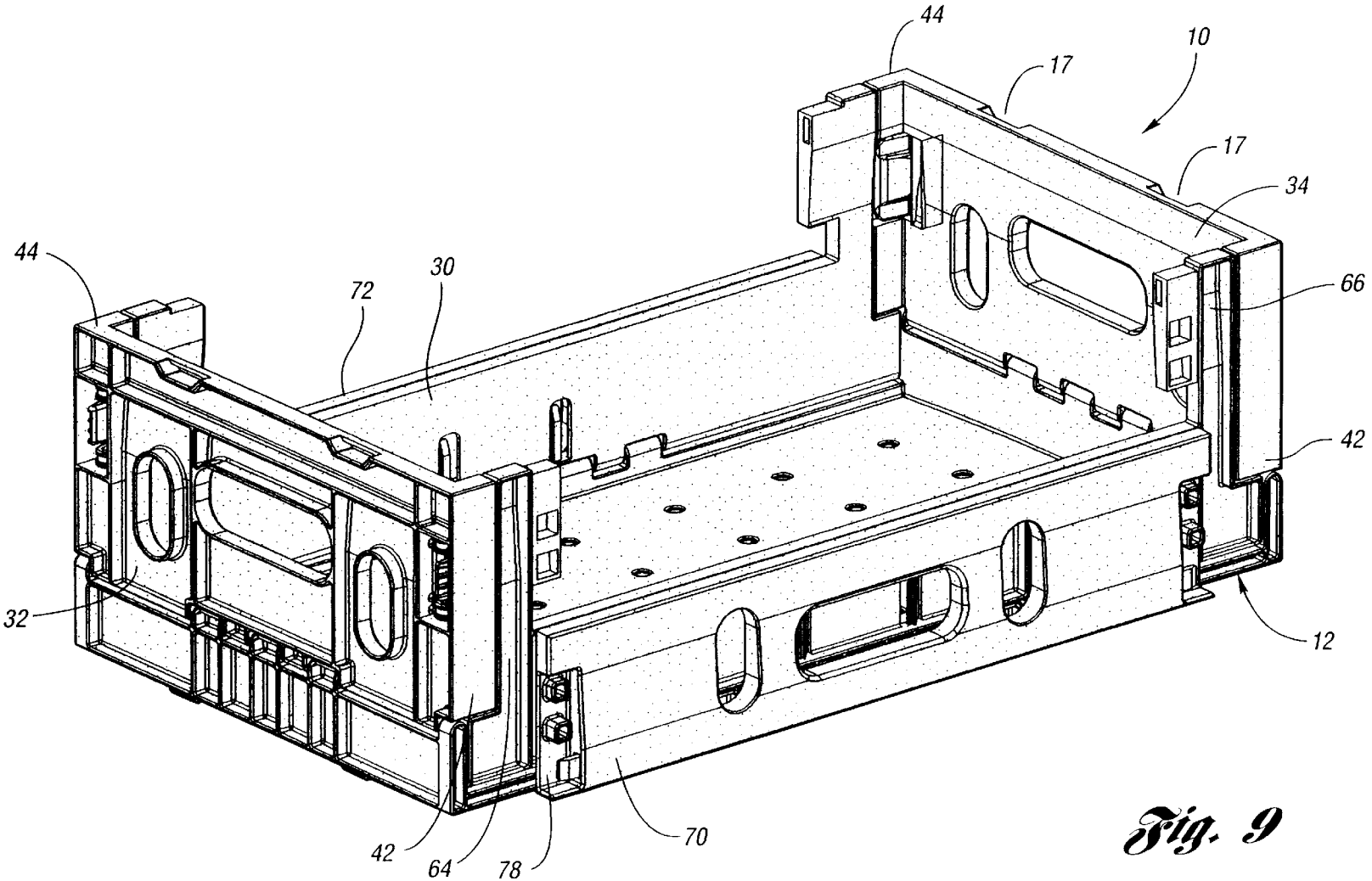
FIG. 9 is a perspective view of the container of FIG. 1 showing the opposed display panels of the side walls in an open position.

By way of example with respect to FIGS. 5, 9, and 11, for latching purposes, shorter flanges 42, 44 of end walls 32, 34 have a latch receiving system 58 provided for receiving latch member 56 therein. Latch receiving system 58 includes a receiver member 59, latch receiving aperture 60 and a living hinge 62. Aperture 60 is appropriately sized and shaped to firmly receive latch member 56. A receiver member 59 is disposed adjacent aperture 60. Receiver member 59 is attached to end wall 32, 34 by living hinge 62, thus allowing it to be flexible over its length, and particularly actuable in the side to side direction. Thus, as a side wall (28 or 30) is raised upwardly and an adjacent end wall (32 or 34) is raised upwardly to receive latch member 56 into the assembled orientation, aperture 60 slidingly receives latch member 56, flexing living hinge 62 laterally causing receiver member 59 to move from its rest position (see FIG. 17) from the rest position.

Figure 16:
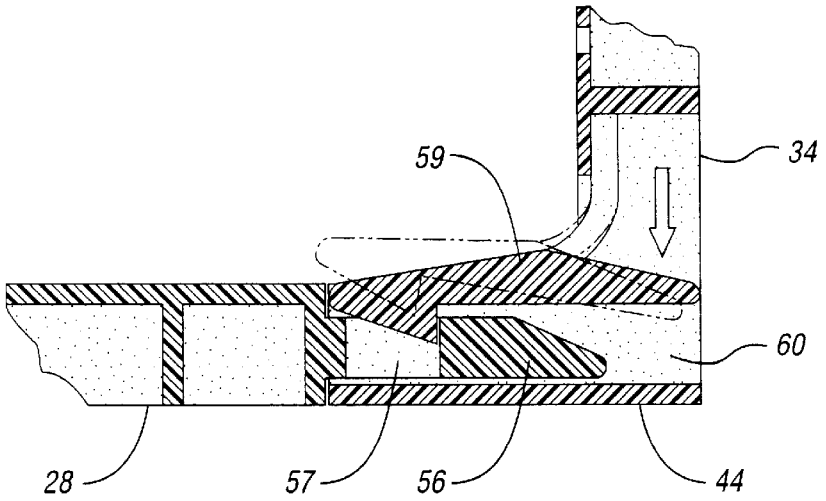
FIG. 16 is a top plan sectional view of the assembled latching system according to the present invention, and taken along line 16—16 of FIG. 8, for latching together side walls and end walls, according to the present invention.
Figure 17:
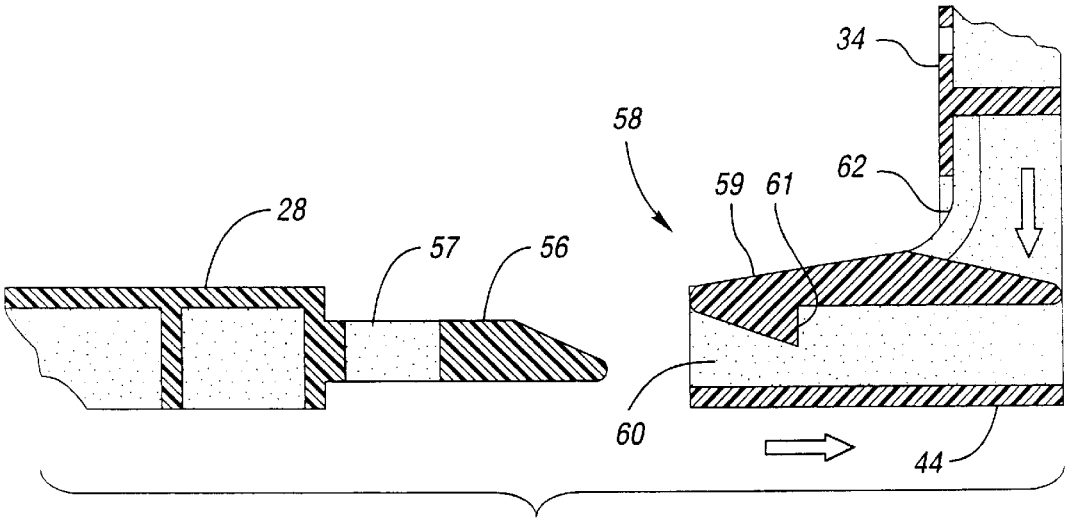
FIG. 17 is a top plan sectional view of the latching system of FIG. 16 in a disassembled orientation, with the side wall shown separated from the end wall.

As illustrated in the top plan sectional views of FIGS. 16–17, and particularly in the final assembled position of FIG. 16, a projection member 61 is disposed on receiver member 59 for being received by a corresponding aperture 57 formed in latch member 56. During the assembled state, projection 61 retains latching member 56 in a secure manner and provides the stability desired for maintaining container 10 in the assembled position. The depth of flanges 42,44 allows for receiving therein a longer latch member 56 than would otherwise be possible.

Figure 3:
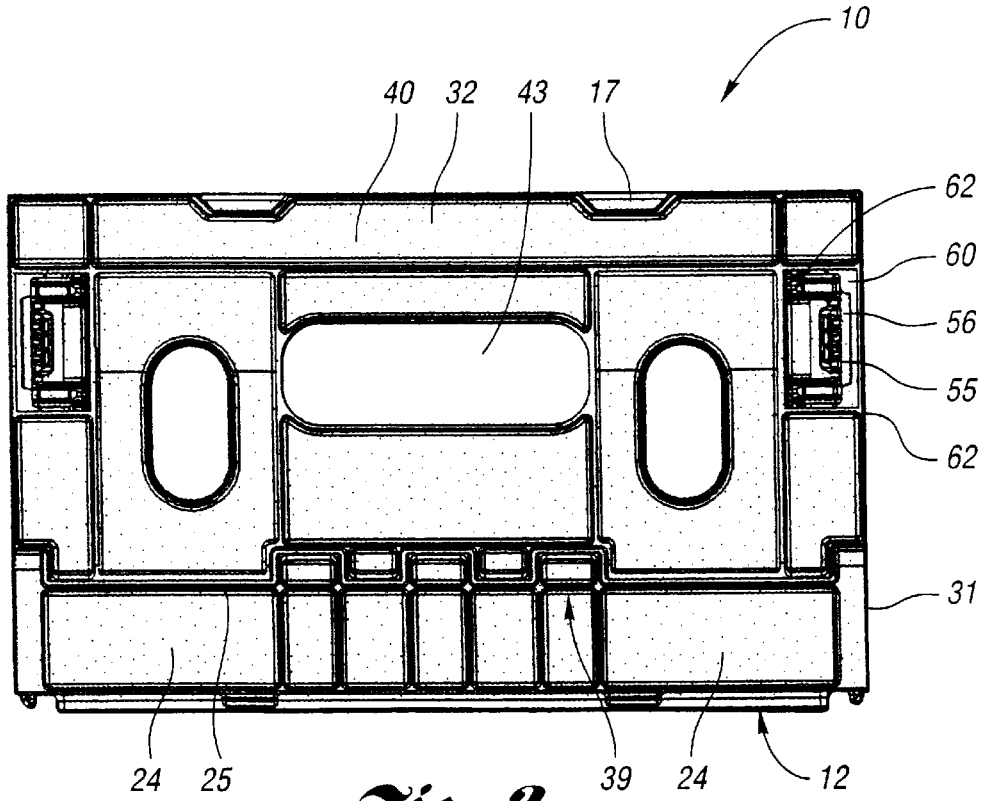
FIG. 3 illustrates an end elevational view of the container of FIG. 1.

As illustrated in the top plan sectional views of FIGS. 16 and 17, in order to collapse container 10 from the assembled orientation into the folded orientations of FIGS. 11 and 12, outer release member 55 (accessible from the outside of container 10) of receiver member 59 is actuated and moved laterally by the user, and projection 61 is accordingly raised from the aperture 57 in latch member 56, allowing latch member 56 (shown in phantom in FIG. 16) to be released from latch receiver 58. Release member 55 is best illustrated in FIGS. 1, 3, and 12.

Figure 6:
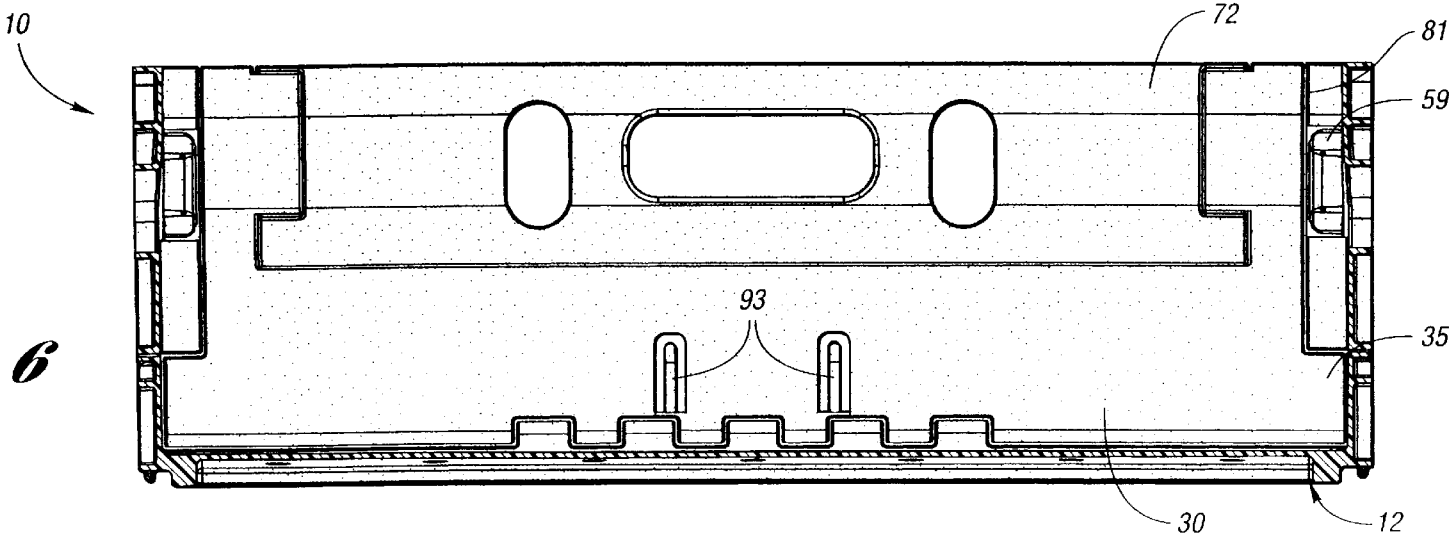
FIG. 6 is a sectional view of the container taken along the line 6—6 of FIG. 4.
Figure 10:
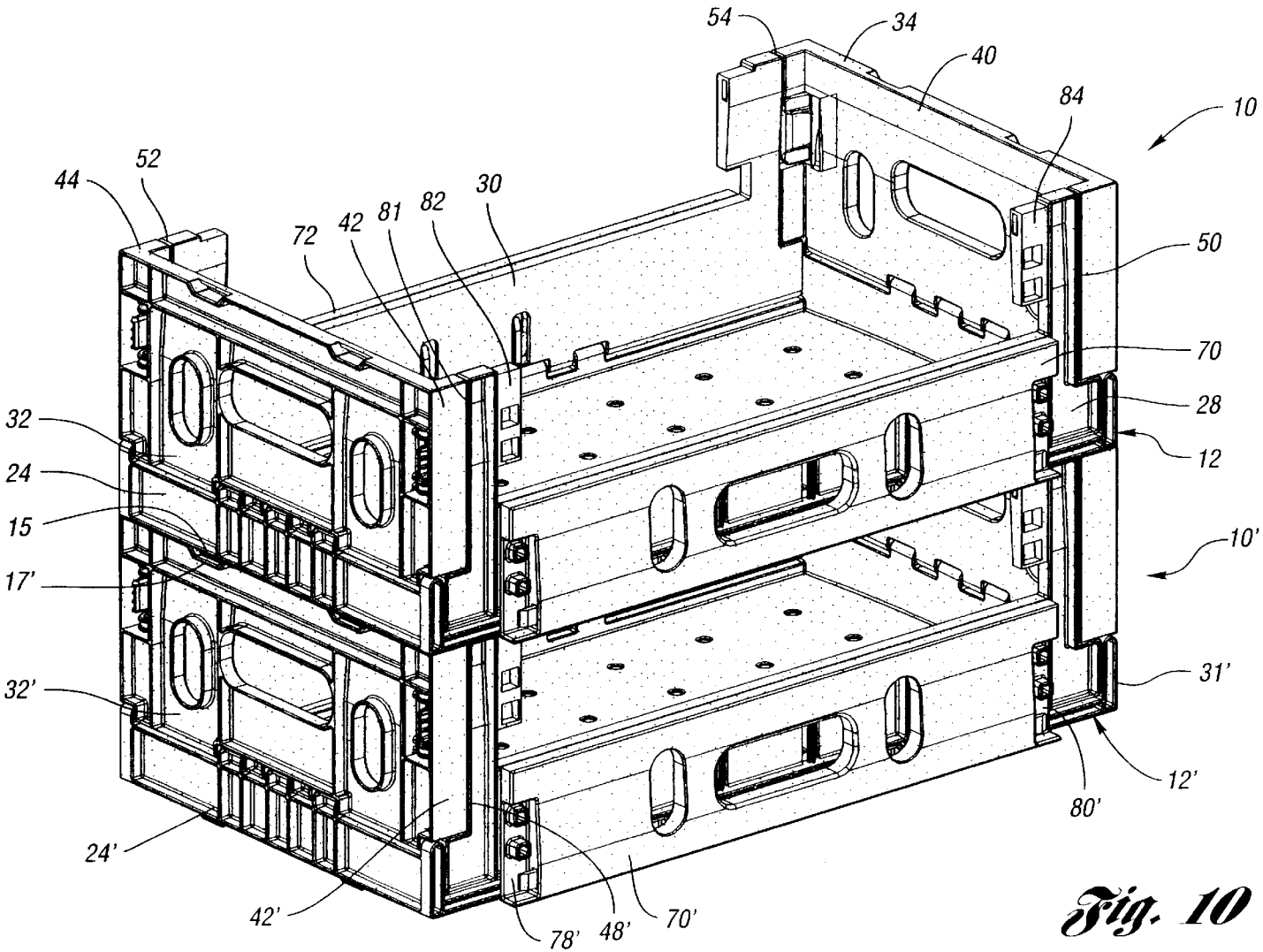
FIG. 10 illustrates two like containers according to the present invention in a stacked orientation, with the display panels of each container in an open position.

The reduced stress concentration of the latch mechanism as provided according to the present invention is further illustrated in FIGS. 2, 6 and 10. By example, refer to line 81 which is formed by the mating lateral edges of side wall 28 and end wall 32 (for example, the line 81 defined by lateral edge 48 of side wall 28 and flange 42 of end wall 32). The latching that takes place is spaced apart from corner line 31 which otherwise is subjected typically to relatively higher stress concentration forces.

In addition to latch member 56, each lateral edge (48,50) and (52,54) of side walls 28 and 30, respectively, may also include a first tab member 45, shown as relatively large and elongated, which projects from a lower portion of its respective edge of side walls 28 and 30 for alignment purposes. In an assembled container 10, tab member 45 is received by a corresponding opening 47 which resembles a narrow slot on shorter flanges 42, 44. The opening receives first tab member 45 in a secure fit for providing a manner by which to align and orient the adjoining walls, as well as secondarily assisting in securely holding side walls (28 and 30) and end walls (32 and 34) upright together during the assembled orientation. Moreover, upper portion of lateral edges (48, 50) and (52, 54) of side walls 28 and 30, respectively, may also include a second tab member 49 which is relatively smaller than first tab member 47. Like first tab member 47, in the assembled orientation second tab member 49 is received by a corresponding tab opening 51 formed in flanges 42 and 44 of end wall 32,34. Tab member 49 is provided generally for alignment purposes as well as to provide an additional point of engagement between the adjoining walls.

In keeping with the present invention, container 10 also includes at least one display panel member 70 (or merchandising panel member) to provide visibility and access to the contents of container 10 under circumstances when access to the container may not be otherwise available. Such circumstances may include a container which has like containers stacked thereon, or has other objects placed thereon, such that conventional access through the upper opening of the container is difficult or inconvenient. In a preferred embodiment illustrated in FIGS. 1–12 herein, container 10 includes a plurality of display panel members, one embodiment of which being the pair of opposed panels members 70 and 72 illustrated in FIGS. 1 and 9–10, wherein container 10 is shown symmetrical about its centerlines.

FIG. 1 illustrates panel member 70 in a closed orientation and FIG. 8 illustrates display member 70 in an open orientation which allows visibility and access to the contents of container 10. FIGS. 9–10 illustrate both display panels 70 and 72 in an open position which allows access and visibility to container 10 from both sides. In particular, side walls 28 and 30 each include a corresponding display panel 70, 72 which is generally rectangular and foldably pivots about its respective side wall between the closed position and the open position.

For purposes of an example, the following discussion refers to display panel 70, but the discussion is equally applicable to panel 72. As best shown in the first embodiment of container 10 and with reference to FIGS. 1 and 8, display panel 70 is disposed within side wall 28 and includes an upper edge 74 which serves as the upper edge of side wall 28 and is generally flush and co-planar with the upper edge of the other portions of container 10, such as upper edge 73 of end walls 32, 34 and upper edge 29 of the remainder of side walls 28, 30. Note that upper edge 74 of display panel 70 is generally co-linear with upper edge 29 of side panel 28.

As further illustrated, when panel member 70 is in its open position (see FIGS. 8–10), upper surface 74 of panel member 70 is designed in terms of placement and height so that it does not project below the plane defined by bottom surface 14, but instead is preferably shorter than or flush with bottom surface 14 so that panel member 70 in the open position does not interfere with the stability of base 12 on a resting surface or interfere with its stackability with other containers. Panel member 70 is pivotably attached to its respective side wall by a hinge portion 75, and which is preferably an integrally molded integral living hinge but may be any other type of hinge feasible according to the design for attaching panel member 70 to its corresponding side wall 28. For example, panel member 70 may be attached its corresponding side wall by way of hinge portions 37 or 39, which are used to mount walls to base 12 herein. Of course, panel member 70 may also be removably attached to its respective side wall.

FIGS. 8–10 illustrate panel member 70 in an open position in which it is parallel to its corresponding side wall 28 such that it folds approximately 180° and lies generally in a plane parallel with its adjacent side wall 28. However, it is contemplated that panel member 70 may be foldable and orientable at any angle between 0° and 180°, as desired. Further, while panel member 70 is shown in FIGS. 8–10 as being folded in an outward manner, it is also contemplated that panel member 70 may cooperate with its corresponding side wall 28 such that it is capable of folding inward, again, at any angle between approximately 0° and 180°. Moreover, while panel member 70 is shown pivoted relative a substantially horizontal axis, it is also contemplated that panel member 70 may also be attached to its corresponding side wall such that it pivots around and in relation to a vertical axis. With reference again to FIG. 8, it is noted that panel members 70,72 each includes a lower edge 76 which corresponds to and meets with intermediate edge 77 of side wall 28, 30 at the location of living hinge 75.

When in its closed orientation, panel member 70 is securely attached (again, preferably integrally) to its corresponding side panel 28. FIGS. 8–10 illustrate one method of securely latching the other portions of display panel 70 to side wall 28. Particularly, panel member 70 has a pair of opposed recessed edges 78 and 80 at its outboard edges, which correspond to and mate with a pair of opposed members 82 and 84 of side wall 28, respectively. Particularly, opposed members 82, 84 are integrally formed with outboard portions 64,66 of side wall 28. Outboard portions 64, 66 are those portions of sidewall 28 which mount with end walls 32, 34 and which are releasably mounted to panel member 70. Opposed members 82, 84 project inwardly from a corresponding edge 86,88 of side wall 28. Recessed edges 78,80 of panel member 70 each include a first and second alignment member 90 and 92, respectively, and a panel latch member 94. As panel member 70 is moved between the open position of FIGS. 8–10 to the closed position of FIG. 1, alignment members 90,92 are received within corresponding apertures 96,98, of outboard portions 64, 66, respectively, for aligning panel member 70 with its corresponding side wall.

With reference now to FIGS. 1 and 6, it is illustrated that panel member 70 also includes a panel latch mechanism which is preferably finger actuable for opening panel member 70. Specifically, in the embodiment illustrated, panel member 70 is opened by releasing panel latch member 94 of latch mechanism from its corresponding aperture 100 formed in side wall members 82,84. As further shown in FIG. 2, for example and not limitation, latch release mechanism 102 includes a finger actuable portion 104 and a spring portion 106 which are attached to and cooperate with latch 94 such that when a user pulls portion 104 in an inward direction, it thereby compresses spring 106 and acts to release latch 94 from its secured position in aperture 100, thereby allowing panel member 70 to be opened. Of course, it is fully contemplated that various methods may be practiced according to the present invention for retaining and attaching display members 70, 72 to its respective side wall.

Accordingly, as illustrated, panel member 70 is movable and pivotable independent of its corresponding side wall 28 to which it is attached. While plurality of panel members 70 and 72 are illustrated as being attached to and cooperating with side walls 28 and 30, respectively, it is fully contemplated that container according to the present invention may cooperate with one or more side and end walls (28, 30, 32 and 40) such that the container may have one, two, three or four display panels, as desired and is practicable, according to the application and use.

As illustrated in FIGS. 1–4 and 8–11, container 10 preferably includes a plurality of recesses 17 (or notches) around its perimeter formed in upper container edges 29, 73, and 74. As illustrated in FIG. 10, container 10 is in an assembled orientation and is stacked with a like container 10' subjacent thereto. Components of container 10' similar to those of the container 10 are correspondingly numbered, with the addition of a prime (') designation. Container 10 is stacked directly above container 10' such that each of its plurality of foot tabs 15 are aligned with and are received within corresponding recesses 17' of container 10'. Such alignment between foot tab 15 and recess 17' provides additional stability and alignment to container 10 when in a stacked orientation with like container 10'. Note that when panel member 70 is shown as open in a stack of containers 10, such stability and alignment between stacked containers exists on the remaining assembled walls between corresponding feet 15 and recesses 17'. Recesses 17 are shown as being disposed and located in various locations including upper surface 74 of panel members 70,72. In the event that one or more panel members 70 are included in container 10, and it is desired that panels 70 be in their open position, recesses 17 and corresponding feet 15 may also be located towards the corners (i.e. outboard portions 64, 66 of side walls 28,30 and end flanges 42, 44) and away from corresponding panel members 70 so that such alignment and stability may be enhanced.

Figure 19:
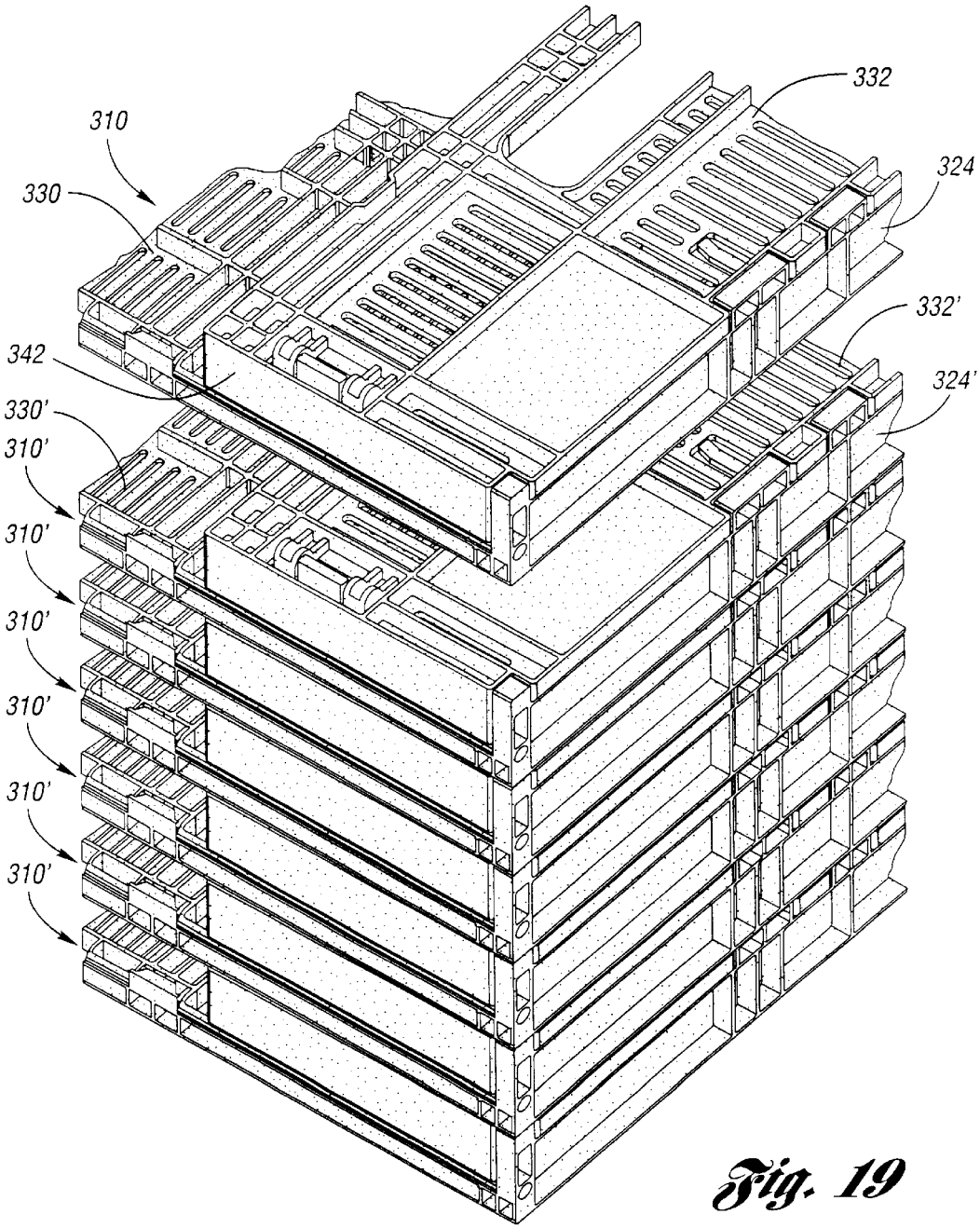
FIG. 19 is a perspective view of a plurality of containers according to the present invention which are inwardly folded as shown in FIG. 12 and which are stacked together in a stacked orientation.

Referring to FIG. 11, container 10 is illustrated in an outwardly folded configuration wherein side walls 28,30 and end walls 32,34 are collapsed and folded in an outward orientation. This configuration provides for a low profile. With reference now directed to FIG. 12, shown therein is container 10 having side walls 28,30 and end walls 32,34 oriented in an inwardly collapsed or folded orientation. Again the term inwardly designates a general direction of movement of the various walls toward base 12 and bottom panel 14. As FIG. 12 indicates, the design according to the present invention allows container 10 to be compactly folded for storage and transport. In this orientation, side walls 28 and 30 are pivoted inward via hinging mechanism 37,39 and folded in a layered fashion on top of bottom panel 14. FIG. 12 illustrates side wall 28 folded first and side wall 30 subsequently folded thereupon. Subsequently end walls 32 and 34 are folded inward on top of side walls 28 and 30 via latching system 39. With reference to FIG. 19 and discussed herein, container 10 may be nested with a similar container when in this inwardly folded orientation.

As shown in FIGS. 1–3 and 11, each of side walls (28, 30) and end walls (32, 34) include a hand opening 41 and 43, respectively, ideally suited to be used as a handle in order to carry container 10. With reference to FIGS. 1 and 2, container 10 also includes a pair of flexible vertical tabs 93 formed integrally with side walls 28, 30 so that a label, index card or other identifier may be inserted and held therein.

Figure 13:
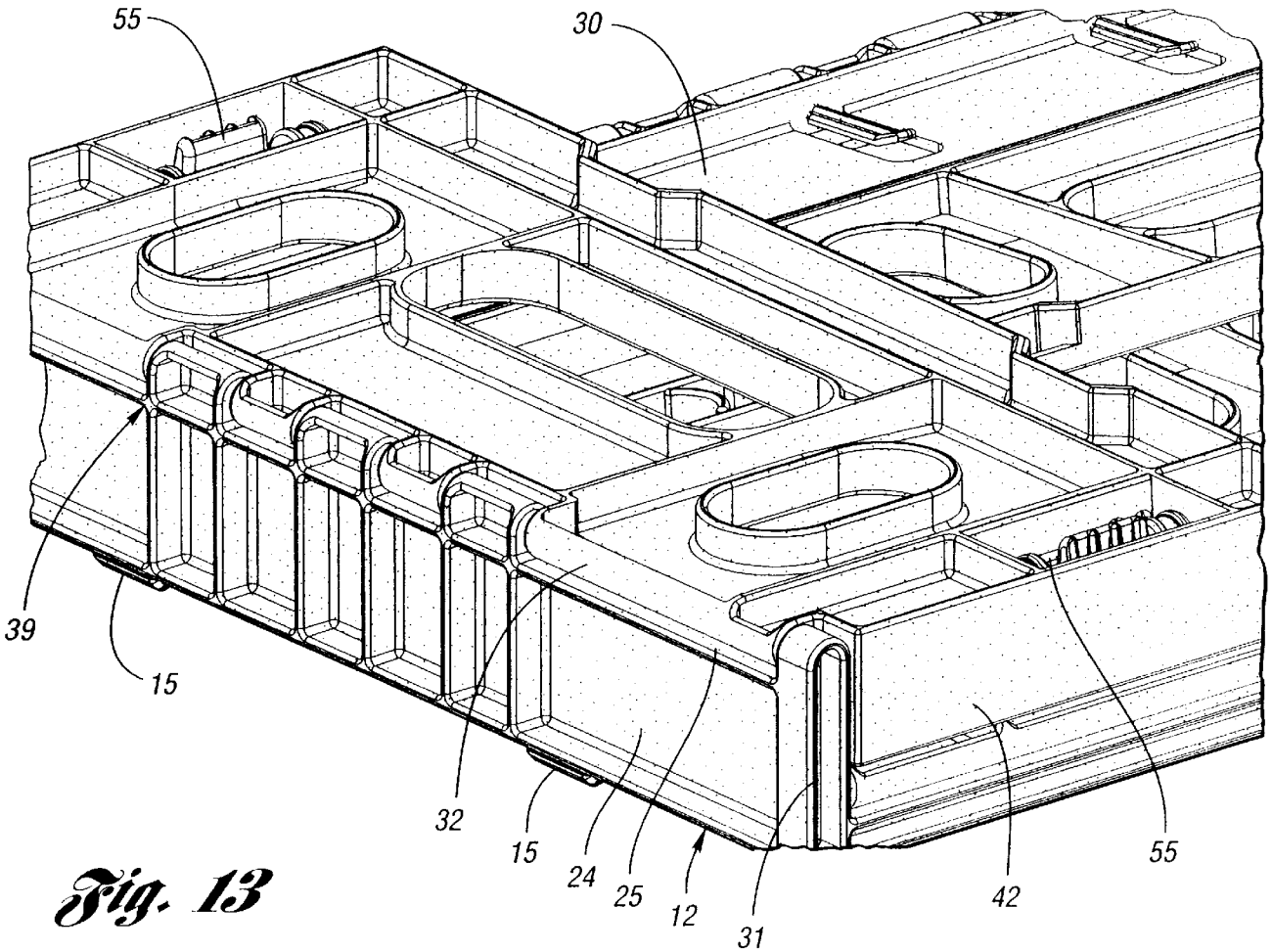
FIG. 13 is an enlarged perspective view of the end wall portion of FIG. 12 illustrating the hinge mechanism according to the present invention for retaining the side walls and end walls to the base of the container.

With regard to hinging systems of container 10, shown in association with base 12 of FIG. 13 are the hinging systems 37 (for side walls) and 39 (for end walls). Specifically, hinging systems 37 and 39 include a plurality of lower hinge members integrally formed with base 12 to mate with and attach to upper hinge members included on the respective side walls. These hinge members are spaced apart and centered along the length of the respective edge. Mating hinge portions are spaced and centered along their respective lower edges of side walls (28,30) and end walls (32,34) for mating with corresponding lower base hinge members of the base. Of course, this type of hinge is shown by way of example and not limitation, as the hinge system utilized may be any type known or contemplated which is feasible for this use.

Figure 21:
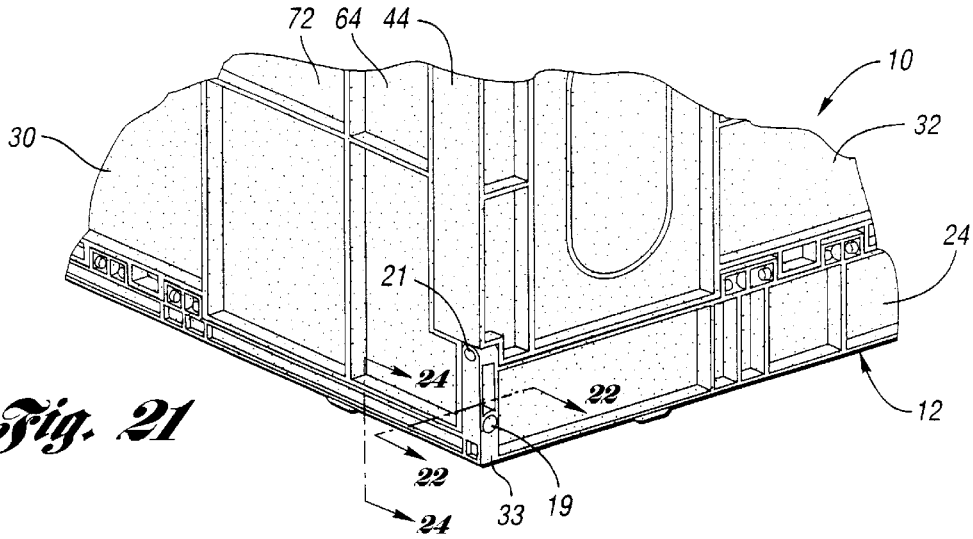
FIG. 21 is a perspective view of a corner portion of container 10 according to the present invention.
Figure 22:
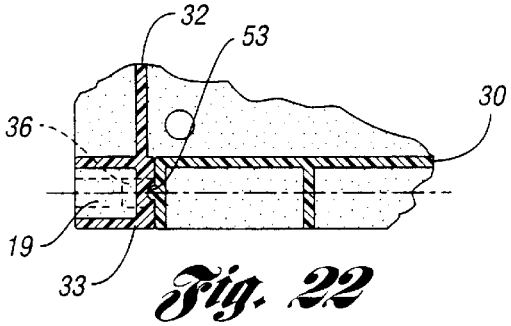
FIG. 22 is a sectional view taken along the line 22—22 of FIG. 21.
Figure 23:
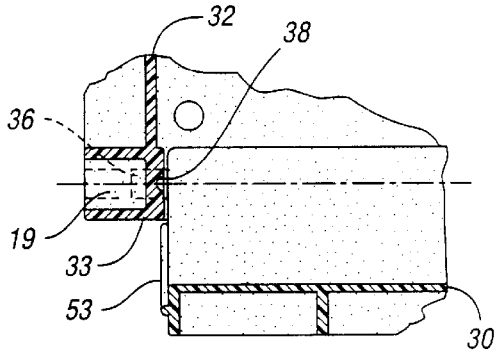
FIG. 23 is a sectional view similar to that shown in FIG. 22, but with the end wall in an outwardly folded orientation.

As illustrated in the partial perspective view of FIG. 21, base 12 includes at either end of upstanding flange 24,26 an upstanding corner portion 33 (or mounting post) which projects upward past upper edges 25 and 27 and is integrally formed with upstanding flanges 24 and 26. Each corner portion 33 includes two openings 19 and 21 formed therein. Each corner portion 33 also defines a corner line 31. Opening 19 is located relatively lower and opening 21 is located relatively higher along the height of corner portion 33. Each co-linear pair of openings 19 is provided to receive a corresponding projection 36 (shown in phantom in FIGS. 22 and 23) provided at each end of a corresponding side wall (28,30) for providing an additional pivoting point for each side wall with respect to base 12. Conversely, each co-linear pair of openings 21 share an axis generally adjacent upper surface (25,27) of upstanding wall 24,26. As shown in the sectional views of FIGS. 22 and 23, openings 21 are provided to receive a corresponding projection or other member (similar to projection 36) provided at either end of each end wall (32,34) thereby allowing each end wall to pivot with respect to base 12. Thus openings 19 and 21 provide for an additional pivot point and anchor point along the lateral sides of each wall, thus allowing for a stable hinging configuration.

Figure 24:
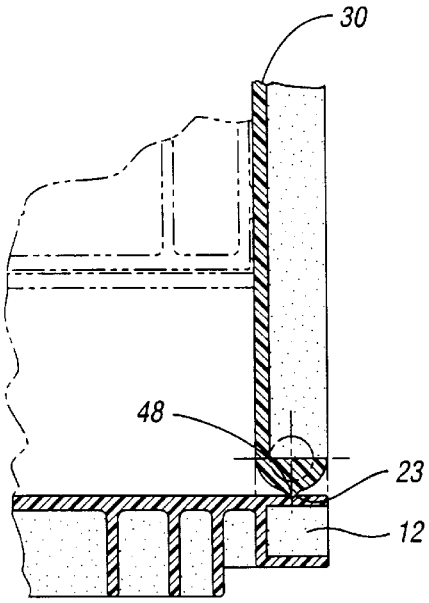
FIG. 24 is a sectional view taken along the line 24—24 of FIG. 21.
Figure 25:
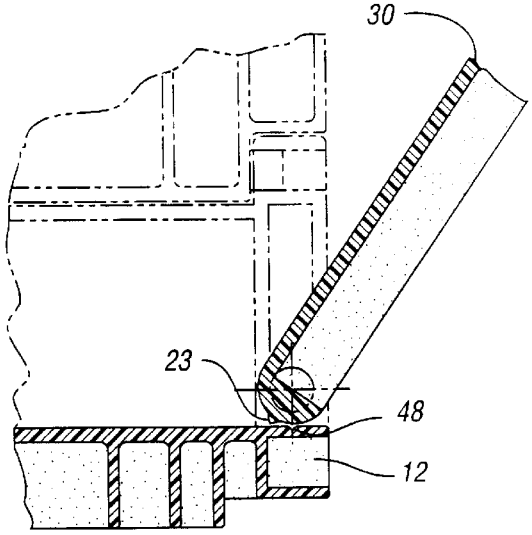
FIG. 25 is a sectional view similar to that shown in FIG. 24, but with the side wall in an outwardly folded orientation.

As illustrated in the sectional views of FIGS. 24 and 25, the lower edge of each side wall may include a relatively small detent 23 (or ridge) which is received in a corresponding channel in base 12. Referring again to FIGS. 22 and 23, the side walls may include a projection 53 which extends along the edge of the sidewall that mates with and corresponds to corner portion 33, and is received by a mating channel 38. These projections allow for interference between the walls the corresponding base and corner portions, such that when the walls are moving between the assembled and the collapsed orientations, the walls preferably do not fall freely, but instead require assistance from the user (however minimal). Thus, during container assembly, the user does not need to support all four walls when attempting to assemble the container.

As shown in FIGS. 5 and 11, side walls (28, 30) have a portion 35 that extends into the corner area and projects outboard beyond edge 48, 50 and which includes the portions that pivot in relation to corner portion 33. FIG. 7 is a schematic bottom plan view of container 10 which allows for nesting of similar containers 10 on top of each other when they are in the inwardly folded orientation (as in FIG. 12). This design permits an inwardly collapsed container 10 to be stacked on top of a like folded container so that the resulting stack-up is stable (see FIG. 19).

Figure 18:
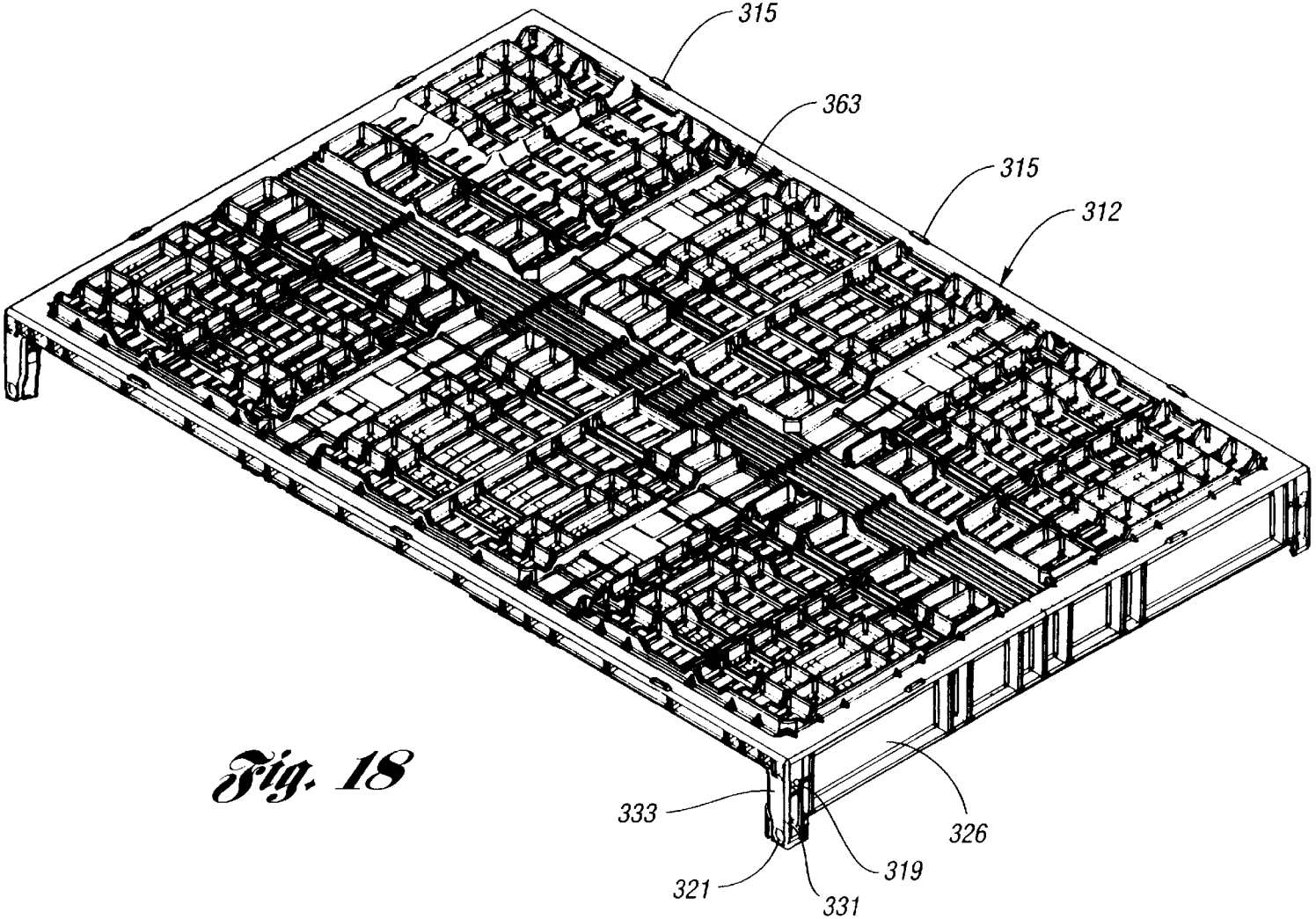
FIG. 18 is a bottom perspective view of the base and bottom surface according to the present invention, illustrating its design to allow for nesting of like containers when in the inwardly folded orientation, as in FIG. 12.

Particularly with reference to FIGS. 18–20, illustrated is another embodiment of a container 310 according to the present invention, and particularly such that container 310 includes a different base and wall design, but is otherwise similar to the previous embodiments. Components similar to those of the first embodiment are correspondingly numbered, with the addition of a "3" prefix. FIGS. 19–20 shown the nesting orientation of lower surface 363 of bottom panel 314 engaging end walls 332',334' of a subjacent nested container 310', the end walls having a corresponding design, allowing like containers 310 and 310' to securely nest. A more detailed illustration of the bottom surface 363 of base 312 is illustrated in the perspective view of FIG. 18, illustrating its design to allow for nesting of like containers when in the inwardly folded orientation, as in FIG. 12.

Figure 20A:
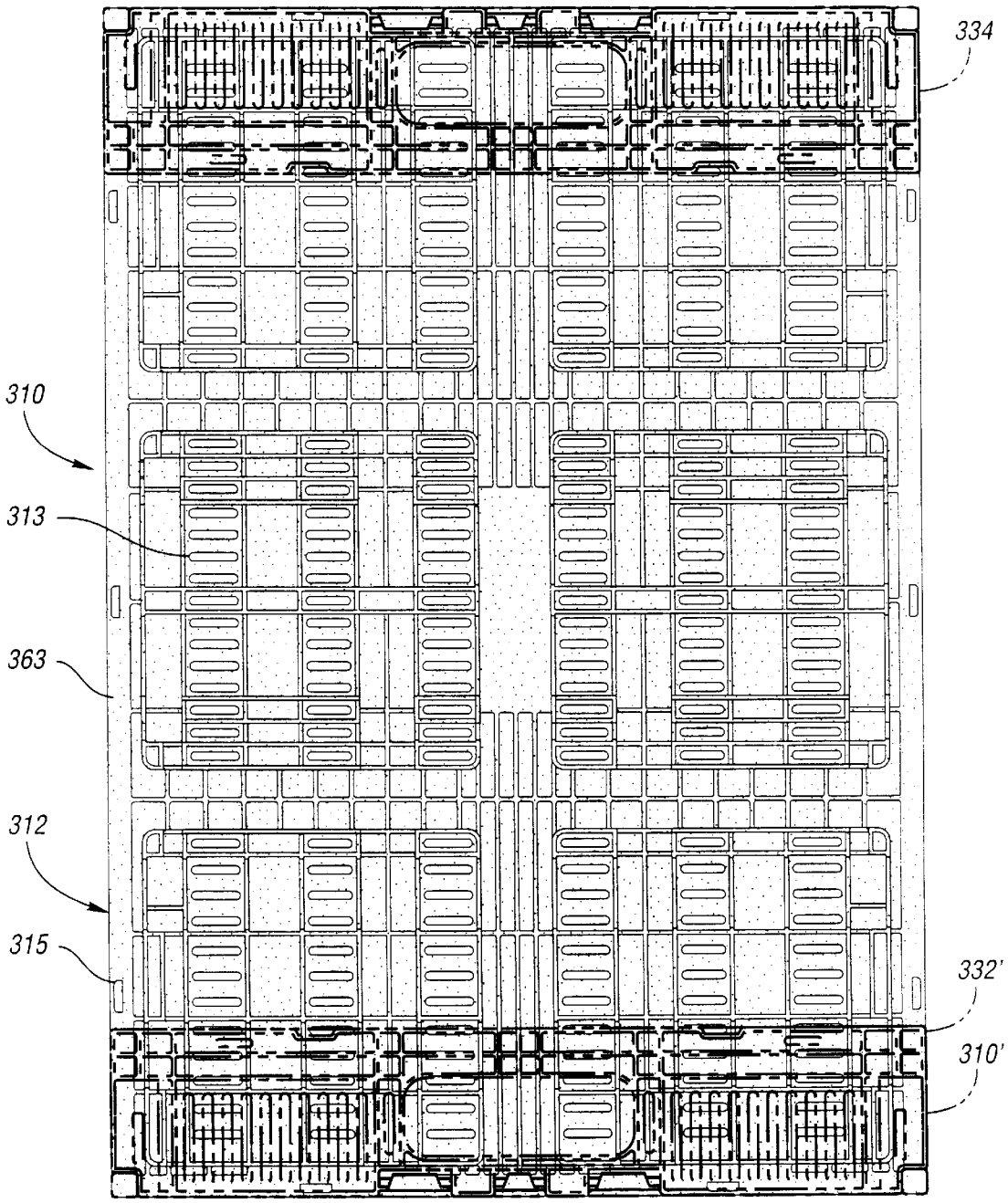
Figure 20B:
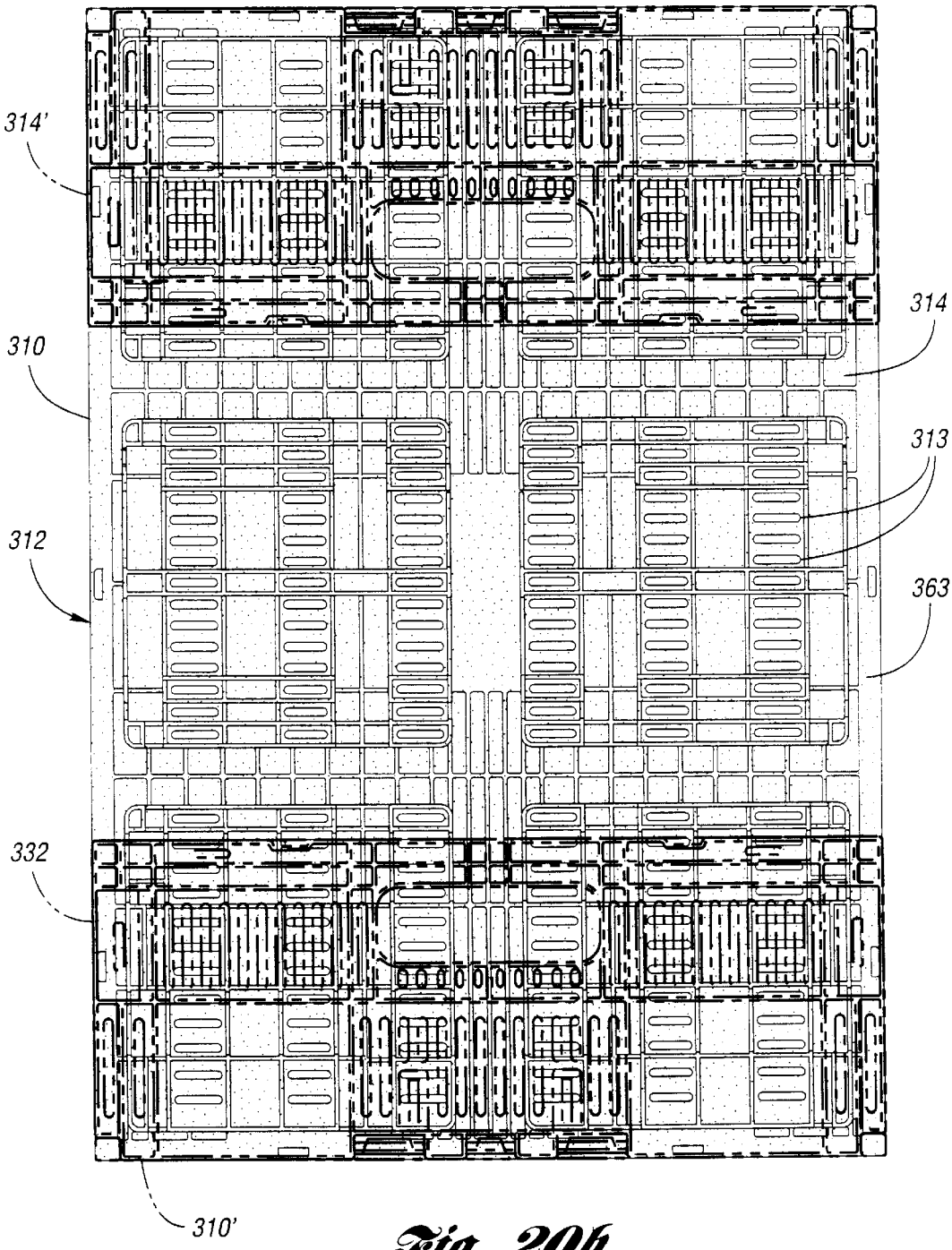
Figure 20C:
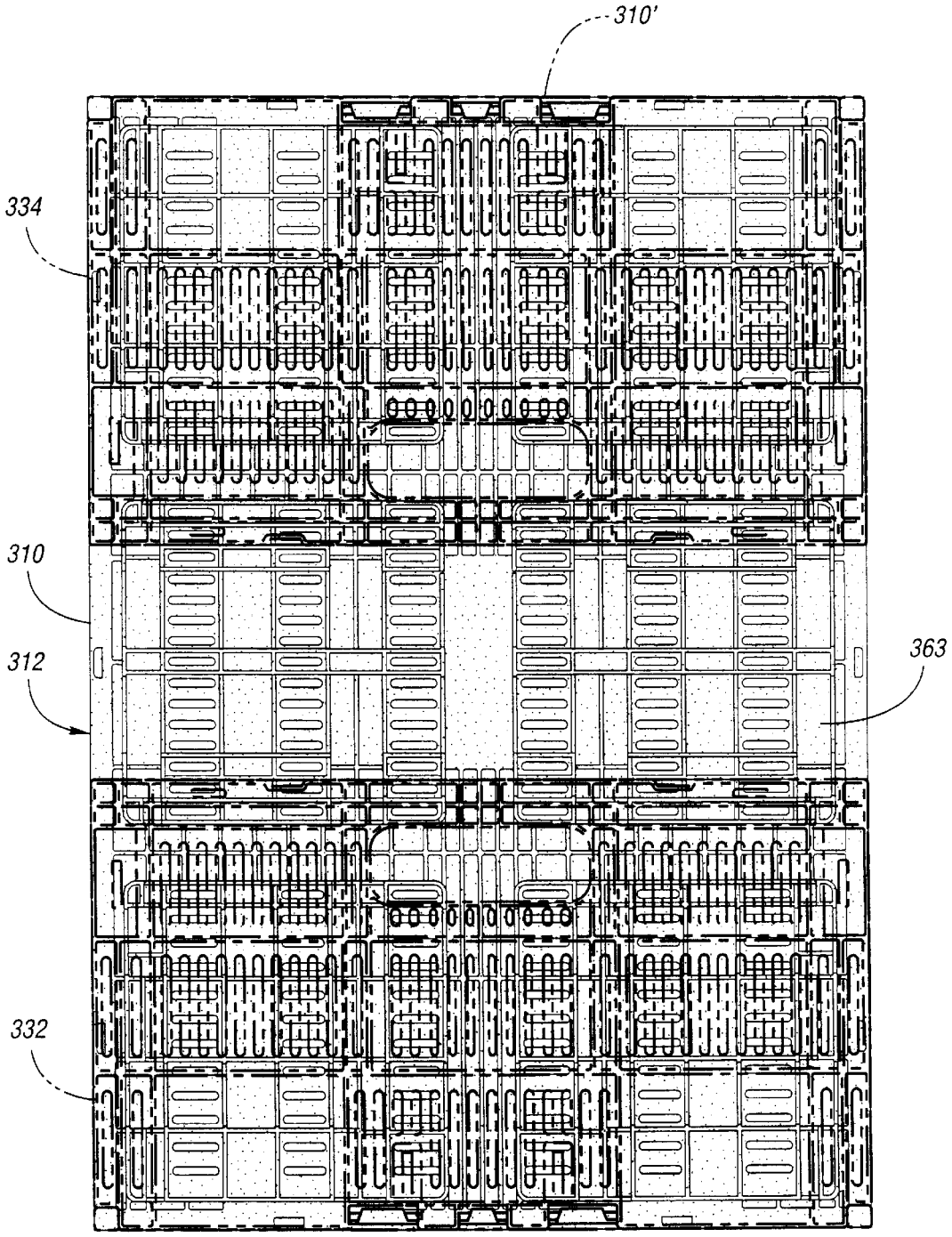

FIG. 19 is a perspective view of a plurality of containers 310 and 310' according to the present invention which are inwardly folded as shown in FIG. 12 and which are in a nested orientation. FIGS. 20*a*–20*c* illustrates the nesting of the container embodiment of FIG. 19. Specifically, FIGS. 20*a*–*c* illustrate a plan view of two like containers 310 and 310' in the inwardly folded and nested orientation as shown in FIG. 19. For ease of reference, bottom surface 363 of container 310 is illustrated in solid lines, while the folded end walls 332', 334' of the subjacent container 310' are shown in phantom, such that the bottom surface 363 design mates with and accommodates the corresponding outer surface of inwardly folded end walls 332', 334' to provide for a stable and secure nested configuration. In keeping with the present invention, it is fully contemplated that bottom surface 363 of base 12 (best shown in FIG. 18) may be designed to provide the proper rib patterns and recesses to be capable of accommodating various end walls heights, including a first, relatively short end wall height (FIG. 20*a*), a second, intermediate end wall height (FIG. 20*b*), and a third, relatively long end wall height (FIG. 20*c*). In the schematic top plan view of FIG. 7, bottom surface 63 includes a drag rail 68 having a plurality of openings 69 positioned and spaced apart therein for providing clearance for the mating end walls 32,34 when containers 10 and 10' are in a nesting orientation.

Figure 14A:
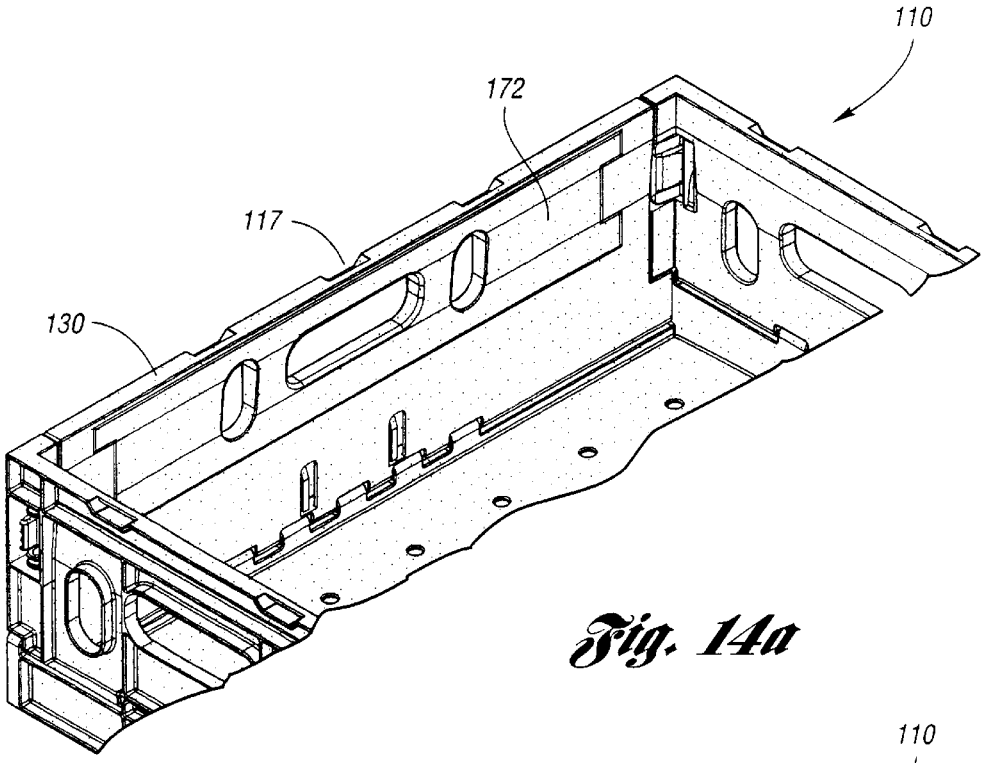
FIGS. 14*a* and 14*b* illustrate a partial view of a second embodiment of a container according to the present invention showing the display panel between the open position (FIG. 14*a*) and the closed position (FIG. 14*b*), wherein in the closed position (FIG. 14*a*) the display panel member is enclosed within the side wall, and does not extend to an outer edge of the side wall.
Figure 14B:
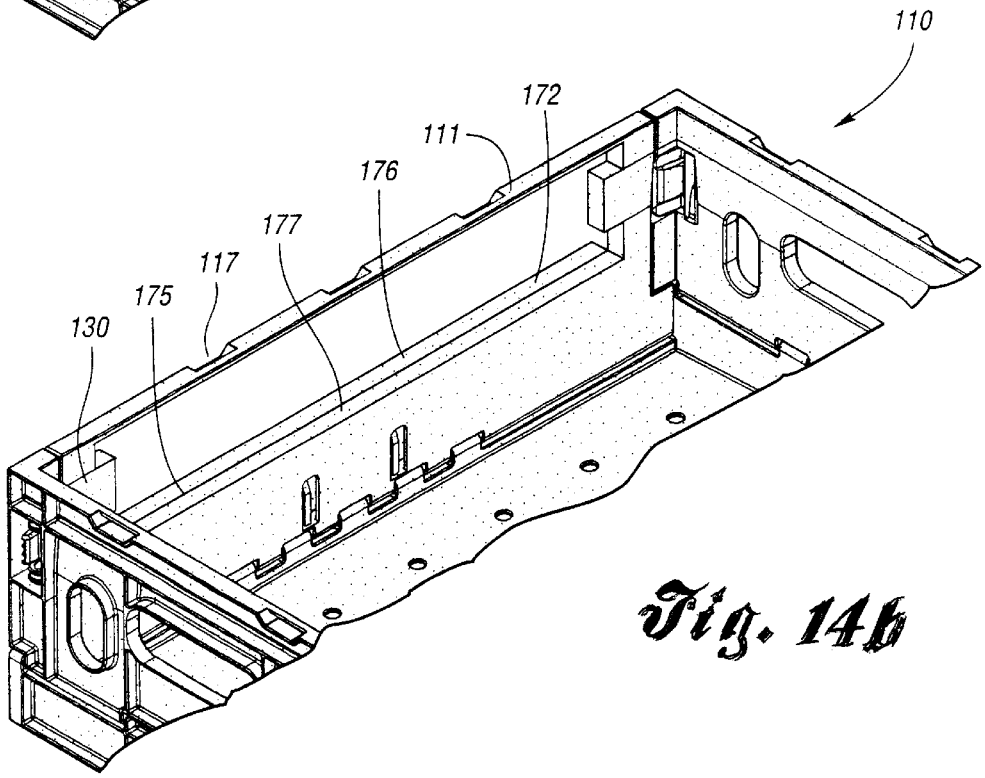

With reference to FIGS. 14*a* and 14*b*, disclosed therein is a second embodiment of a container 110 according to the present invention. Components similar to those of the first embodiment are correspondingly numbered, with the addition of a "1" prefix. As illustrated, container 110 includes a display panel member 172 moveable between a first closed position (FIG. 14*a*) and a second open position (FIG. 14*b*). In the closed position, display panel member 172 of this embodiment is disposed within its corresponding side wall 130, and is surrounded thereby. Thus, while the first embodiment of container 10 illustrates panel member 72 having an upper surface 74 flush and generally co-planar with the remaining side wall upper surfaces, in this embodiment, upper surface 174 of panel member 172 does not extend to and is not flush or co-planar with the remaining container upper surfaces. Accordingly, when container 110 is assembled in a stacked orientation with like containers, its feet 115 are nestable with each of the corresponding recesses 117 of the lower subjacent container because no recesses 117 are absent due to a folded display panel 172. This serves to enhance the stability and integrity of the stack of containers 110. Note that in the assembled orientation, upper portion 111 of sidewall 130 is independent of panel member 172 and remains in an assembled orientation when panel member is open or closed.

Figure 15A:
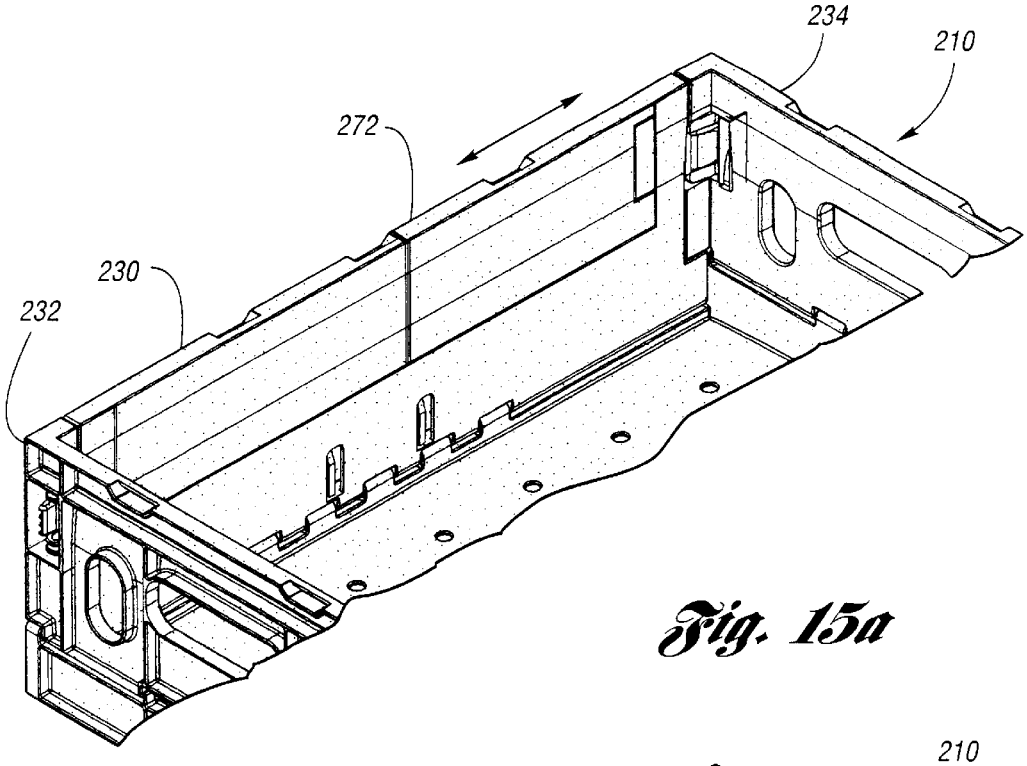
FIGS. 15*a* and 15*b* illustrate a partial view of a third embodiment of a container according to the present invention wherein the display panel member is slidingly received within its corresponding side wall between a closed position (FIG. 15*a*) and open position (FIG. 15*b*)
Figure 15B:
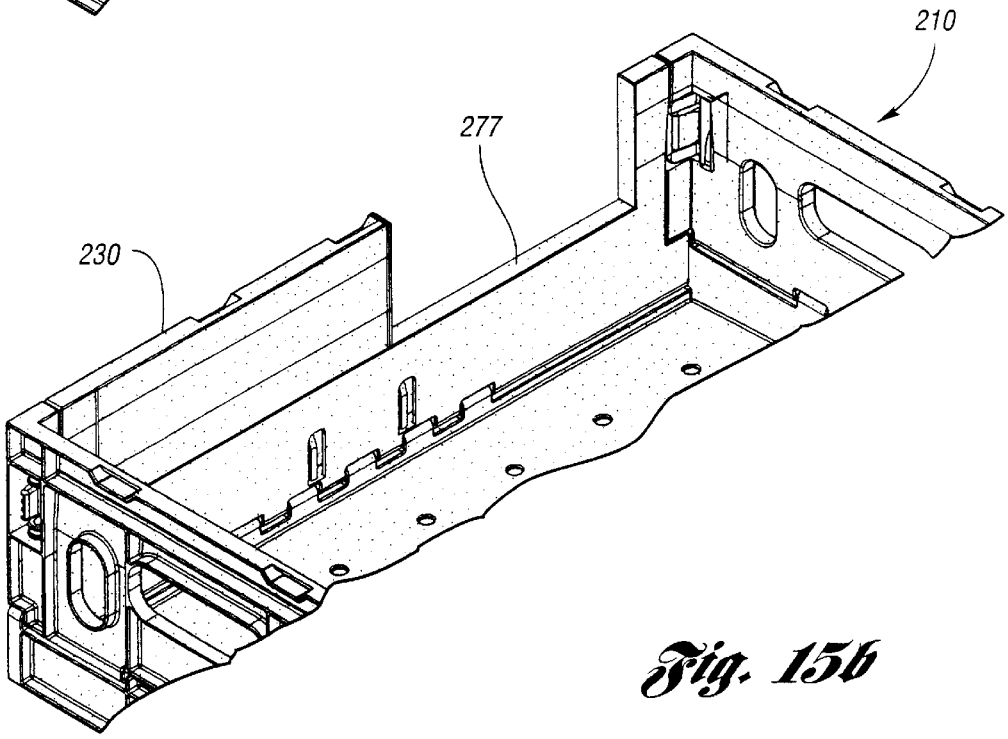

It is contemplated according to the teachings of the present invention that a display panel member may be attached to its corresponding side wall in various ways in order to reach the objects and goals of the present invention. For example, as illustrated in FIGS. 15*a* and 15*b*, a partial container view of a third embodiment of container 210 is shown having a panel member 272. Components similar to those of the first embodiment are correspondingly numbered, with the addition of a "2" prefix. Panel member 272 is a sliding panel and which is slidably received by and within its corresponding side wall 230. As illustrated, panel member 272 slidably moves between a closed position (FIG. 15*a*) and the open position (FIG. 15*b*) for allowing access to the container, in the direction designated by the arrow illustrated in FIG. 15*a*. Of course, depending on the size and orientation of the sliding mechanism and components, panel member 272 may be co-planar or in a plane parallel to its side wall 230. As in the second embodiment shown in FIGS. 14*a* and 14*b*, display panel member 272 may also be disposed within its corresponding side wall 230 such that its upper surface is not co-planar with its side wall upper surface 229, but instead so that its upper surface is positioned below the side wall upper surface.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. A collapsible container, comprising:

a base; and a pair of opposed side walls each pivotably attached to the base and orientable between an assembled position and a second position, at least one of the side walls having a lower edge portion extending thereacross, the at least one side wall further including a display member mounted thereto above the lower edge portion and axially movable between a closed position and an open position, wherein in the open position the display member is slidably received by the at least one side wall for providing access to an interior portion of the container.

2. The collapsible container of claim 1, wherein the at least one side wall includes an upper perimeter portion disposed above the display member, such that the display member is not co-planar with an upper surface of the container in the assembled position.

3. The container of claim 1, wherein when the display member is in the closed position and the at least one side wall is in the assembled position, the display member is generally co-planar with the at least one side wall.

4. The container of claim 1, wherein when the display member is in the closed position and the at least one side wall is in the assembled position, the display member is disposed in a plane generally parallel with the at least one side wall.

5. The container of claim 1, wherein the display member has a display member upper edge and the at least one side wall has a side wall upper edge, wherein when the display member is in the closed position and the at least one side wall is in the assembled position, the display member upper edge is substantially co-linear with the side wall upper edge.

6. A collapsible container, comprising:

a base; and a pair of opposed side walls each pivotably attached to the base and orientable between an assembled position and a second position, at least one of the side walls having a display member mounted thereto which is movable between a closed position and an open position, wherein in the open position the display member is slidingly received by its corresponding side wall for providing access to an interior portion of the container.

7. The container of claim 6, wherein when the display member is in the closed position and the at least one side wall is in the assembled position, the display member is generally co-planar with the at least one side wall.

8. The container of claim 6, wherein the display member is releasably mounted to the at least one side wall.

9. The container of claim 6, wherein when the display member is in the closed position and the at least one side wall is in the assembled position, one of the display member and the at least one side wall includes a latch member and the other of the display member and the at least one side wall includes a recess for receiving the latch member.

10. The container of claim 6, wherein the display member has a display member upper edge and the at least one side wall has a side wall upper edge, wherein when the display member is in the closed position and the at least one side wall is in the assembled position, the display member upper edge is substantially co-linear with the side wall upper edge.

11. The container of claim 6, wherein the at least one side wall has a lower edge portion and an upper edge portion extending thereacross, the upper edge portion defining an upper surface of the at least one side wall, and the display member is disposed below the upper edge portion and above the lower edge portion.

12. The container of claim 6, wherein when the display member is in the closed position and the at least one side wall is in the assembled position, the display member is disposed in a plane generally parallel with the at least one side wall.

13. The container of claim 6, further comprising a second pair of opposed side walls each pivotably attached to the base and orientable between an assembled position and an unassembled position, each of the second pair of opposed side walls releasably mounted to an adjacent one of the pair of opposed side walls.

14. The container of claim 13, wherein one of the pair of opposed side walls and the second pair of opposed side walls each includes a pair of opposed lateral flanges inwardly depending therefrom and integral therewith, each lateral flange having a latch receiver formed therein, the latch receiver including an aperture and a flexible latch hinge and having a latch release member actuable by a user.

15. The container of claim 14, wherein the other of the pair of opposed side walls and second pair of opposed side walls each includes a pair of opposed lateral edges, each lateral edge having a latching member attached thereto, wherein when the container is oriented in an assembled position, each lateral flange abuts an adjacent lateral edge so that each aperture receives a corresponding latching member which is fastened into position by the latch hinge, thereby forming a secure attachment between the first and second pairs of opposed side walls, and wherein to return the container to a collapsed position from the assembled position, each latch release member is actuated by the user in order to release the latching member fastened therein.

16. The container of claim 13, wherein the base includes a first and second pair of opposed edges, the pair of opposed side walls and the second pair of opposed side walls pivotably attached to a corresponding one of the first and second pair of opposed edges.

17. The container of claim 16, wherein one of the first and second pair of opposed edges are each defined by an upstanding base wall.

18. The container of claim 6, wherein when the pair of side walls are oriented in the second position, they are oriented in one of an inwardly folded orientation or an outwardly folded orientation.

19. The container of claim 6, wherein the base has an upwardly directed curve formed therein.

20. A collapsible container orientable between an assembled position and a collapsed position, comprising:

a base;

a pair of opposed first side walls pivotably attached to the base, at least one first side wall movable between an assembled position and a collapsed position, the at least one first side wall having a lower perimeter and an upper surface defined by an upper perimeter thereof, the at least one first side wall further having attached thereto a display member axially movable between a closed position and an open position, wherein the display member is disposed below the side wall upper perimeter and above the side wall lower perimeter; and a pair of second opposed side walls pivotably attached to the base and releasably attached to the pair of opposed first side walls, wherein when the display member is in the open position and the at least one first side wall is in the assembled position, the display member is slidably received by and within the at least one side wall and the interior of the container is accessible through the at least one first side wall.

21. The container of claim 20, wherein the display member is releasably mounted to the at least one first side wall.

22. The container of claim 20, wherein the display member is positioned relatively closer to the upper perimeter compared with the lower perimeter.

23. The container of claim 20, wherein the pair of opposed first side walls has a first latch portion, and the pair of opposed second side walls has a second latch portion for attaching the first side walls and second side walls when in the assembled position.

* * * * *